US007167065B2

(12) United States Patent
Aiga et al.

(10) Patent No.: US 7,167,065 B2
(45) Date of Patent: Jan. 23, 2007

(54) FILTER CIRCUIT

(75) Inventors: Fumihiko Aiga, Kanagawa (JP); Tatsunori Hashimoto, Kanagawa (JP); Yoshiaki Terashima, Kanagawa (JP); Mutsuki Yamazaki, Kanagawa (JP); Hiroyuki Fuke, Kanagawa (JP); Hiroyuki Kayano, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 173 days.

(21) Appl. No.: 10/753,336

(22) Filed: Jan. 9, 2004

(65) Prior Publication Data

US 2004/0196114 A1 Oct. 7, 2004

(30) Foreign Application Priority Data

Feb. 26, 2003 (JP) ..... 2003-048517

(51) Int. Cl.
*H01P 1/20* (2006.01)

(52) U.S. Cl. ..... 333/204; 333/202; 333/230

(58) Field of Classification Search ..... 333/202–204, 333/208, 230

See application file for complete search history.

(56) References Cited

U.S. PATENT DOCUMENTS 4,513,263 A * 4/1985 Minnis ..... 333/204
4,521,749 A * 6/1985 Lockhart ..... 332/120
5,170,413 A * 12/1992 Hess et al. ..... 375/260
5,936,490 A * 8/1999 Hershtig ..... 333/202
6,300,849 B1 * 10/2001 Takeda ..... 333/202
6,559,741 B2 * 5/2003 Takeda ..... 333/204
6,831,784 B2 * 12/2004 Takeda ..... 359/579

FOREIGN PATENT DOCUMENTS

JP 2001-60803 3/2001

OTHER PUBLICATIONS

John David Rhodes, "A Low-Pass Prototype Network For Microwave Linear Phase Filters", IEEE Transactions on Microwave Theory and Techniques, vol. MTT-18, No. 6, Jun. 1970, pp. 290-301.

Gerhard Pfitzenmaier, "Synthesis and Realization of Narrow-Band Canonical Microwave Bandpass Filters Exhibiting Linear Phase and Transmission Zeros", IEEE Trnasactions on Microwave Theory and Techniques, vol. MTT-30, No. 9, Sep. 1982, pp. 1300-1311.

Ralph Levy, "Direct Synthesis of Cascaded Quadruplet (CQ) Filters", IEEE Trnasactions on Microwave Theory and Techniques, vol. 43, No. 12, Dec. 1995, pp. 2940-2945.

Richard J. Cameron, et al., "Asymmetric Realizations for Dual-Mode Bandpass Filters", IEEE Trnasactions on Microwave Theory and Techniques, vol. MTT-29, No. 1, Jan. 1981, pp. 51-58.

* cited by examiner

*Primary Examiner*—Linh Nguyen
(74) *Attorney, Agent, or Firm*—Oblon, Spivak, McClelland, Maier & Neustadt, P.C.

(57) ABSTRACT

A filter circuit has a complex block and exciting portions. The complex block has: a first block end resonator; a first resonator that is coupled to the first block end resonator; a second resonator that is coupled to the first resonator; a third resonator that is coupled to the second resonator; a fourth resonator that is coupled to the third resonator; and a second block end resonator that is coupled to the fourth resonator. Couplings between the first block end resonator and the second block end resonator, between the first resonator and the fourth resonator, and between the second resonator and the third resonator are in phase. The complex block and the exciting portions are single-path-coupled.

24 Claims, 15 Drawing Sheets

FILTER CIRCUIT

The present disclosure relates to the subject matter contained in Japanese Patent Application No. 2003-048517 filed Feb. 26, 2003, which is incorporated herein by reference in its entirety.

BACKGROUND OF THE INVENTION

1. Field of the Invention

The present invention relates to a band pass filter, and more particularly to a delay time compensation band pass filter in which the deviation of the group delay time in the pass band is small.

2. Background Art

A communication apparatus which communicates information by radio or with wire is configured by various high-frequency components such as amplifiers, mixers, and filters. Among such components, a band pass filter is formed by arranging a plurality of resonators to exert a function of allowing only a signal of a specific frequency band to pass through the filter.

In a communication system, a band pass filter is requested to have a skirt characteristic which does not cause interference between adjacent frequency bands. A skirt characteristic means the degree of attenuation in a range from an end of the pass band to the stop band. When a band pass filter having a steep skirt characteristic is used, therefore, it is possible to effectively use the frequency.

On the other hand, a band pass filter in a communication system is requested to have a group delay characteristic which is flat in the pass band. Usually, group delay compensation is performed by means of a real zero and a complex zero of a transfer function related to a complex frequency s.

In order to flatten a group delay characteristic, a method in which an equalizer is connected to a subsequent stage of a filter is sometimes employed. However, this method has a problem in that the insertion loss is increased by the loss of the equalizer.

As a filter in which a filter circuit itself performs group delay compensation without using an equalizer, a canonical filter is reported in IEEE Transactions on Microwave Theory and Techniques, Vol. 18 (1970), p. 290. In the filter, first to N-th resonators are sequentially main-coupled, and the first and N-th resonators, the second and (N−1)-th resonators, and the like are sub-coupled, so that an (N/2−1) number of sub-couplings exist in total.

In a canonical filter of six or more stages, flexible group delay compensation is enabled by providing real and complex zeros. Conventionally, this has been applied to a waveguide filer or a dielectric filter. In a canonical filter, however, a zero of a transfer function depends on complicated interactions of all sub-couplings, thereby causing a problem in that it is difficult to adjust the filter characteristic. When a large number of resonators are arranged in the form of a canonical filter with using a planer circuit such as a microstrip line, a strip line, or a coplanar line, it is very difficult to suppress unwanted parasitic couplings, thereby producing a problem in that a desired characteristic is hardly obtained.

As a modification of a canonical filter, a waveguide filer is reported in IEEE Transactions on Microwave Theory and Techniques, Vol. 30 (1982), p. 1300. In this filter, however, resonators are coupled in a more complicated manner than a usual canonical filter, and hence it is difficult to adjust the filter characteristic. There is a problem in that it is very difficult to realize such a filter with using a planar circuit such as a microstrip line, a strip line, or a coplanar line.

As a filter in which a steep skirt characteristic and a flattened group delay characteristic are simultaneously realized with using a planar circuit, known is a cascaded quadruplet filter reported in IEEE Transactions on Microwave Theory and Techniques, Vol. 43 (1995), p. 2940. The cascaded quadruplet filter has a configuration in which four resonators are formed into a set to form one sub-coupling. A steep skirt characteristic can be realized by disposing an attenuation pole due to a pure imaginary zero of a transfer function, and group delay compensation can be realized by a real zero. Since zeros of a transfer function correspond to sub-couplings in a one-to-one relationship, the filter has an advantage that a configuration is enabled in which the filter characteristic is easily adjusted and unwanted parasitic couplings are suppressed in a planar circuit. In such a cascaded quadruplet filter, however, it is impossible to realize a complex zero of a transfer function, and hence there is a problem in that flexible group delay compensation cannot be performed.

An example of a cascaded quadruplet filter is an 8-stage waveguide filter reported in IEEE Transactions on Microwave Theory and Techniques, Vol. 29 (1981), p. 51. This filter is designed by rotation-transforming a coupling coefficient matrix of a circuit in which the coupling between first and eighth stages of an 8-stage canonical filter is made zero. Delay compensation is performed by disposing one real zero. Since a complex zero is not provided, however, the delay compensation cannot be sufficiently performed.

A method of realizing a filter circuit in which a steep skirt characteristic is realized by disposing an attenuation pole due to a pure imaginary zero of a transfer function, and group delay compensation is performed by a real zero is described also in JP-A-2001-60803. In the method, however, it is impossible to use a complex zero of a transfer function, and hence there is a problem in that flexible group delay compensation cannot be performed.

SUMMARY OF THE INVENTION

As described above, there is no filter circuit having a configuration in which both real and complex zeros of a transfer function for group delay compensation can be realized, the filter characteristic is easily adjusted, and unwanted parasitic couplings are suppressed in a planar circuit such as a microstrip line, a strip line, or a coplanar line.

The invention may provide a filter circuit including: a complex block which realizes a complex zero of a transfer function; a real/pure imaginary block which realizes a real zero of a transfer function and a pure imaginary zero of the transfer function; and a single path circuit which couples the complex block with the real/pure imaginary block through a single-path.

Further, the invention may provide a filter circuit including: a complex block which realizes a complex zero of a transfer function; a real block which realizes a real zero of a transfer function; and a single path circuit which couples the complex block with the real block through a single-path.

Further, the invention may provide a filter circuit including: a complex block which realizes a complex zero of a transfer function; a pure imaginary block which realizes a pure imaginary zero of a transfer function; and a single path circuit which couples the complex block with the pure imaginary block through a single-path.

Further, the invention may provide a filter circuit including: a first complex block which realizes a complex zero of a transfer function; a second complex block which realizes a complex zero of a transfer function; and a single path circuit which couples the first complex block with the second complex block through a single-path.

Further, the invention may provide a filter circuit including: having a pass amplitude characteristic with a predetermined pass band, including: a first circuit which realizes attenuation poles on both sides of the predetermined pass band in the pass amplitude characteristic; and a second circuit which realizes a flat group delay characteristic in the pass band; wherein the first circuit and the second circuit are coupled with a single path; the first circuit and the second circuit are coupled with a single path; the second circuit includes: a first end resonator; a first resonator that is coupled to the first end resonator; a second resonator that is coupled to the first resonator; a third resonator that is coupled to the second resonator; a fourth resonator that is coupled to the third resonator; and a second end resonator that is coupled to the fourth resonator; and a coupling between the first end resonator and the second end resonator, a coupling between the first resonator and the fourth resonator, and a coupling between the second resonator and the third resonator are in phase.

BRIEF DESCRIPTION OF THE DRAWINGS

The present invention may be more readily described with reference to the accompanying drawings.

DETAILED DESCRIPTION OF THE EMBODIMENTS

Hereinafter, embodiments of the invention will be described with reference to the accompanying drawings.

First, an example of the basic configuration of the filter of the invention will be described.

Figure 1:
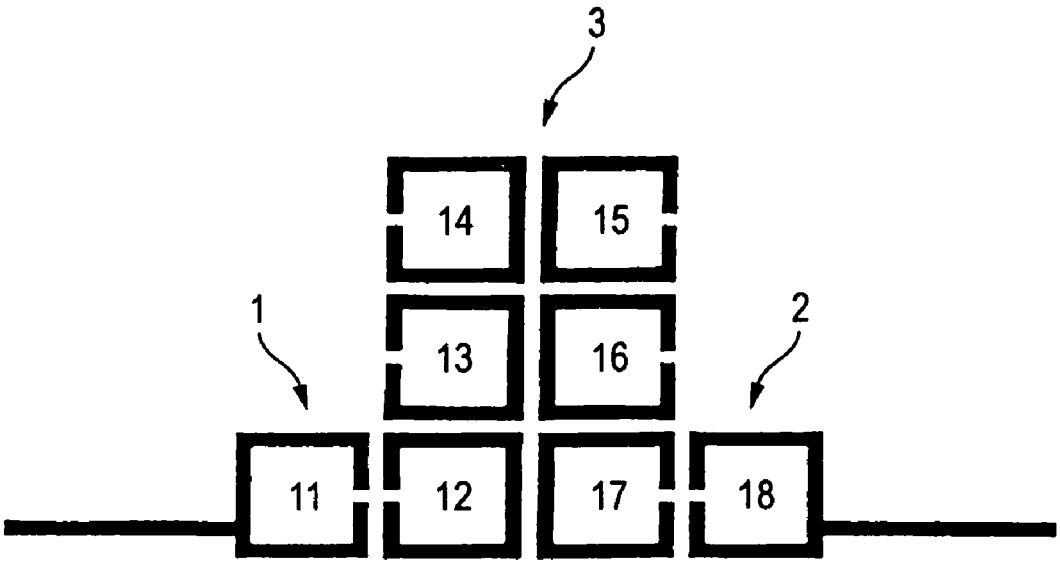
FIG. 1 is a pattern diagram of a filter circuit illustrating the basic configuration of the invention.

FIG. 1 is a pattern diagram illustrating the basic configuration of the filter of the invention.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 11 to 18 are open-loop half-wave resonators. The resonators 11 and 18 are connected to the external to constitute exciting portions 1 and 2, respectively.

The resonators 12 to 17 are coupled in this sequence, so that a complex block 3 is configured by the six resonators. The resonators 12 and 17 serve as end resonators of the complex block 3. The resonators 12 and 17, the resonators 13 and 16, and the resonators 14 and 15 are magnetically coupled to each other. Namely, all the couplings between the resonators 12 and 17, the resonators 13 and 16, and the resonators 14 and 15 are in phase.

In the specification, the expression that couplings are in phase means a combination of magnetic couplings or that of electric couplings. By contrast, a combination of a magnetic coupling and an electric coupling is called to be in anti-phase.

Referring to FIG. 1, in the complex block 3, all couplings between the resonators 12 and 17, the resonators 13 and 16, and the resonators 14 and 15 are configured by magnetic couplings. Alternatively, these couplings may be configured by electric couplings. When these couplings are in phase, it is possible to reproduce a complex zero. Alternatively, the filter may be designed so as to realize two real zeros in place of one complex zero. The place where a complex zero or a real zero is formed in a complex plane can be determined by selecting the arrangement of the resonators constituting the complex block 3. For example, the place can be adjusted by changing the distances between the resonators.

In the specification, for the sake of convenience, both one complex zero and two real zeros which can be realized by the complex block 3 are referred to as a complex zero.

The complex block 3 realizes a complex zero of a transfer function. When a complex zero of a transfer function is realized, group delay compensation is enabled asymmetrically with respect to the center frequency.

The resonators 12 and 17 constitute end portions of the complex block 3 to handle an input to and an output from the complex block 3, and are coupled to the resonators 11 and 18, respectively. Therefore, the exciting portions 1 and 2 are coupled to each other through the complex block 3. The exciting portion 1 and the complex block 3 are coupled to each other by only the coupling between the resonators 11 and 12, and the exciting portion 2 and the complex block 3 are coupled to each other by only the coupling between the resonators 17 and 18. Although the expression of only the coupling between the resonators 11 and 12 has been used in the above, it is a matter of course that couplings which are negligibly weak can exist. A direct coupling between the exciting portions 1 and 2 through a space is negligible because the distance between the portions is large. The fact that the coupling between the exciting portions 1 and 2 through a space is negligible can be ascertained by a circuit simulation in which the filter characteristic in the case where the coupling is considered is not changed from that in the case where the coupling is not considered. When there exists a coupling between the exciting portions 1 and 2 which is performed not through the complex block 3, care should be taken on the phenomenon that it is difficult to adjust the filter characteristic as in a conventional canonical filter.

FIG. 1 shows an example in which the exciting portions 1 and 2 comprise the resonators 11 and 18, respectively. When an exciting portion comprises a resonator in this way, steepening of the skirt characteristic and flattening of the group delay characteristic which are caused by the increased number of filter stages can be further enhanced. However, this does not affect the function of forming a complex zero of a transfer function. Therefore, an external signal line may be connected directly to an end portion of the complex block 3. Furthermore, it is a matter of course that a plurality of resonators can be single-path-coupled to form a signal transmission path, and used as an exciting portion.

In the specification, the expression that resonators or blocks are single-path-coupled means a coupling of resonators which are continuously arranged so that a single signal transmission passage is formed. For the sake of convenience, the coupling includes also the case where one resonator is placed between blocks to attain a coupling, and that where a resonator is not placed and a coupling is directly attained. The signal transmission passage is requested to be single, and is not limited to a passage which is geometrically linearly arranged.

Figure 2:
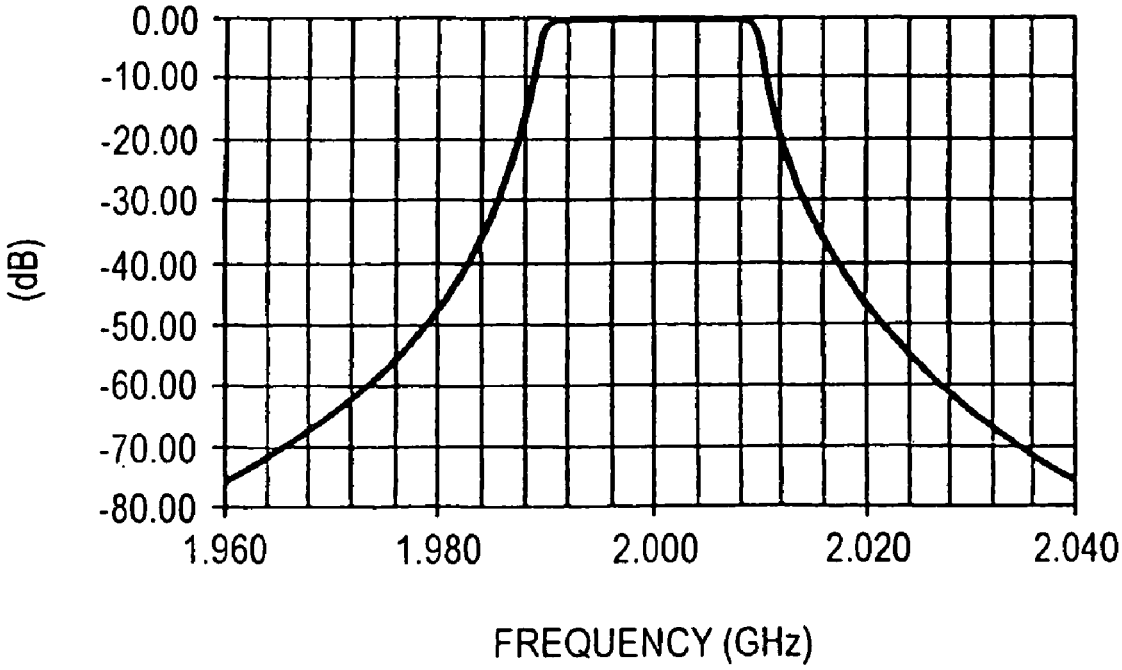
FIG. 2 is a pass amplitude characteristic diagram of the filter circuit illustrating the basic configuration of the invention.

FIG. 2 shows an example of the pass amplitude characteristic of the filter shown in FIG. 1. The abscissa indicates the frequency (GHz), and the ordinate indicates the pass strength (dB). In the design, a normalized low-pass filter in which the transfer function has a zero at $\pm(1\pm0.4j)$ where j is the imaginary unit was used.

The center frequency is about 2 GHz, and the band width is about 20 MHz. The pass strength is substantially constant in the pass band, and begins to attenuate at frequencies of about 1.99 GHz and 2.01 GHz. It will be seen that, as the frequency further separates from the center frequency, the pass strength is more sharply attenuated so as to realize an excellent skirt characteristic. Namely, a desired pass characteristic is realized without being disturbed by unwanted parasitic couplings.

Figure 3:
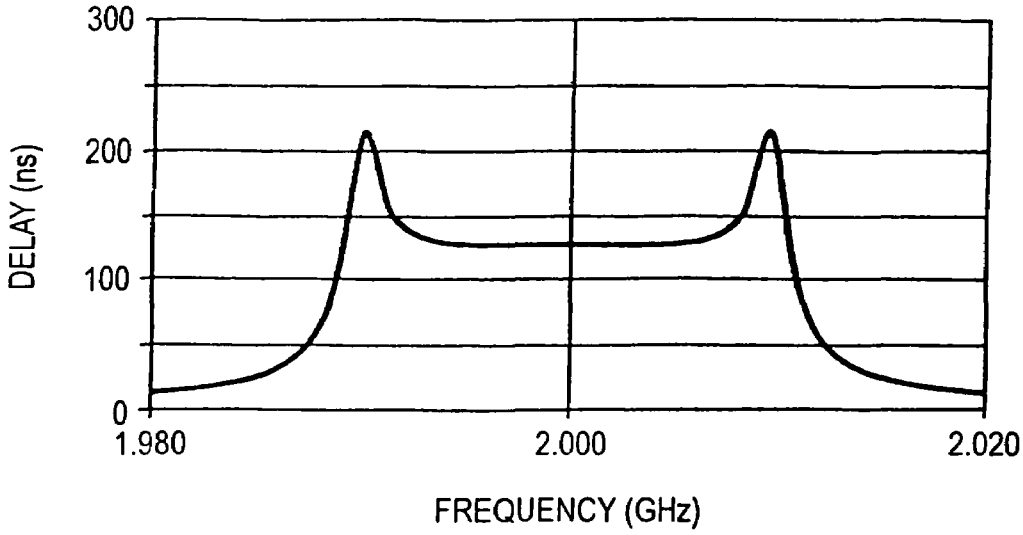
FIG. 3 is a group delay characteristic diagram of the filter circuit illustrating the basic configuration of the invention.

FIG. 3 shows an example of the group delay characteristic of the filter. The abscissa indicates the frequency (GHz), and the ordinate indicates the delay time (ns).

The delay time is satisfactorily flattened in the pass band having the width of about 20 MHz centered at the center frequency of 2 GHz. Namely, a flat group delay characteristic is realized by the complex zero of the transfer function.

Figure 4:
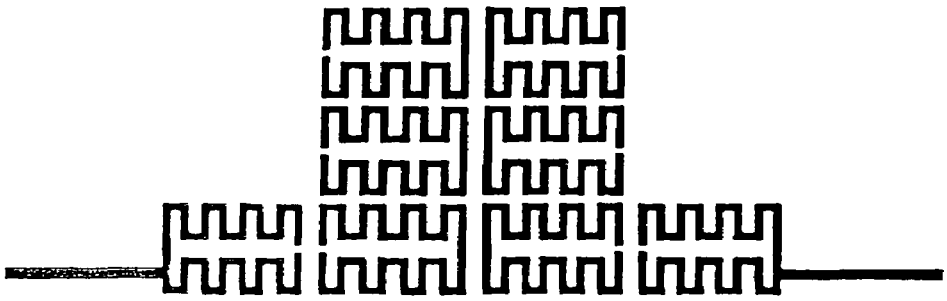
FIG. 4 is a diagram showing an example in which meander open-loop resonators are used.
Figure 5:
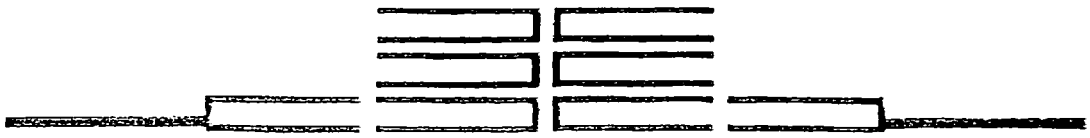
FIG. 5 is a diagram showing an example in which hairpin resonators are used.

In the above, the example in which the rectangular resonators are used has been described. Alternatively, various kinds of resonators such as a so-called open-loop resonator including a meander open-loop resonator having further bends (for example, FIG. 4), and a hairpin resonator (for example, FIG. 5) may be used.

Figure 6:
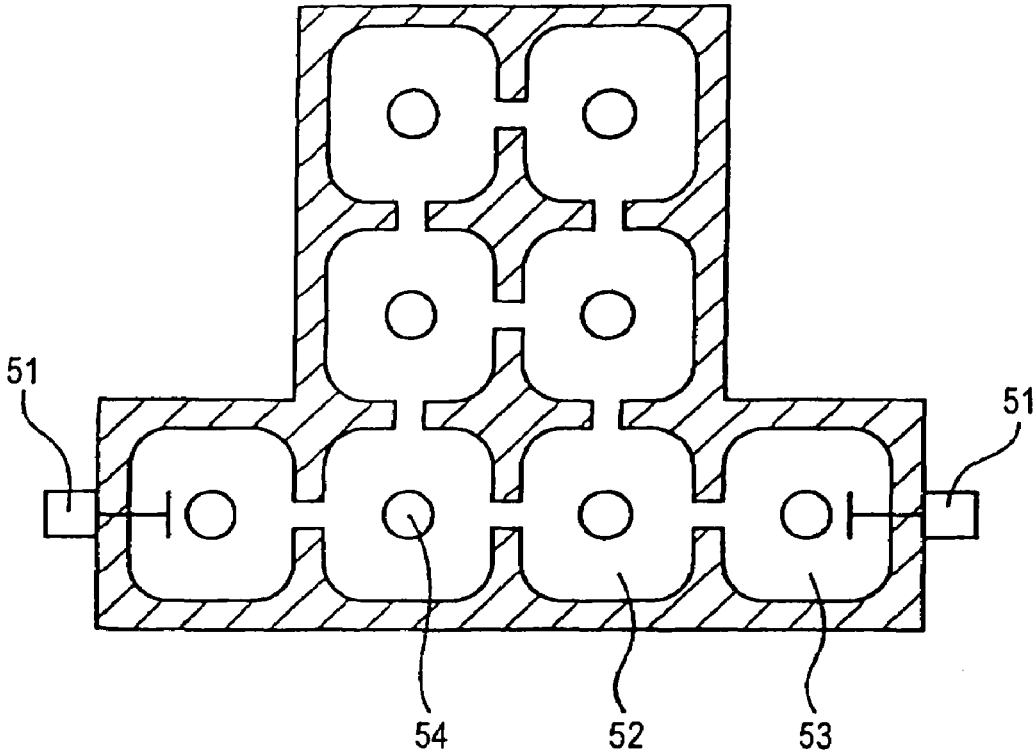
FIG. 6 is a diagram showing an example in which coaxial cavity resonators are used.

The example in which the circuit is configured by a microstrip line has been described. Alternatively, the circuit may be configured by a strip line. Also in the case of a waveguide filter or a dielectric filter, the filter may be configured in a similar manner. FIG. 6 shows an example in which a waveguide filter is used. The waveguide filter includes block cavities 52 and excitation cavities 53 between input/output terminals 51. A conductor 54 is disposed at the center of each of the block cavities 52 and the excitation cavities 53. Couplings between the block cavities 52 and the excitation cavities 53 can be designed in the same manner as the above-described case of the microstrip line. According to the configuration, the filter characteristic can be adjusted more easily than in a conventional canonical filter.

A superconductor may be employed as a conductor which is used in the waveguide filter or the dielectric filter.

Figure 7:
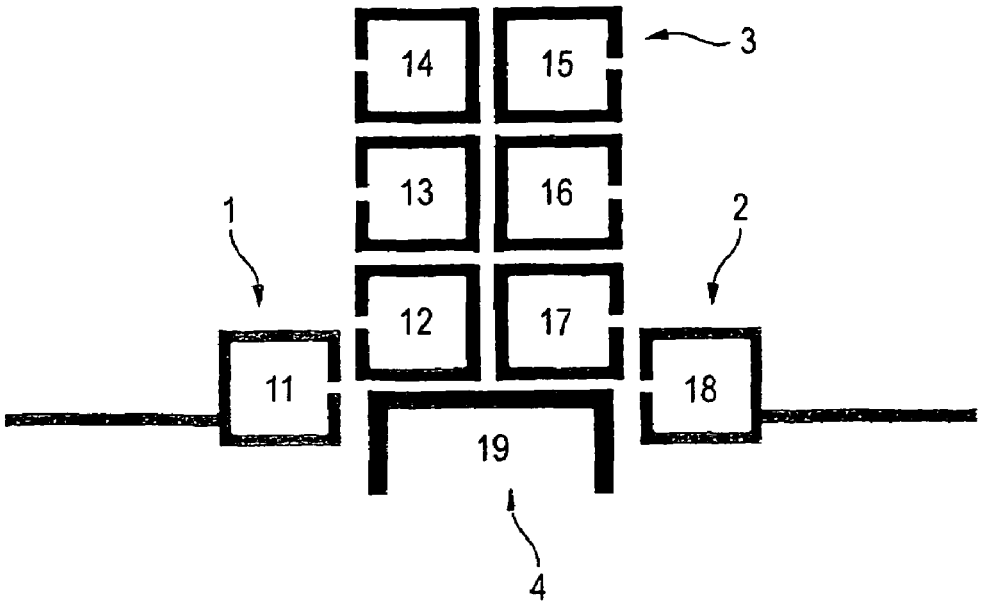
FIG. 7 is a diagram of a modification of the filter circuit illustrating the basic configuration of the invention.

The distance between the exciting portions 1 and 2 is set to be large in order to prevent the exciting portions 1 and 2 from being coupled to each other directly or not through the complex block 3. As shown in FIG. 7, for example, unwanted parasitic couplings may be suppressed with using a plate of a metal such as copper. In the configuration of FIG. 1, a metal plate 4 is interposed between the exciting portions 1 and 2, and the metal plate is grounded to prevent a direct coupling from occurring.

All the couplings between the resonators are determined by the positional relationships among the resonators. Alternatively, a coupling line may be disposed between resonators so as to attain a coupling between them.

(Embodiment 1)

Figure 8:
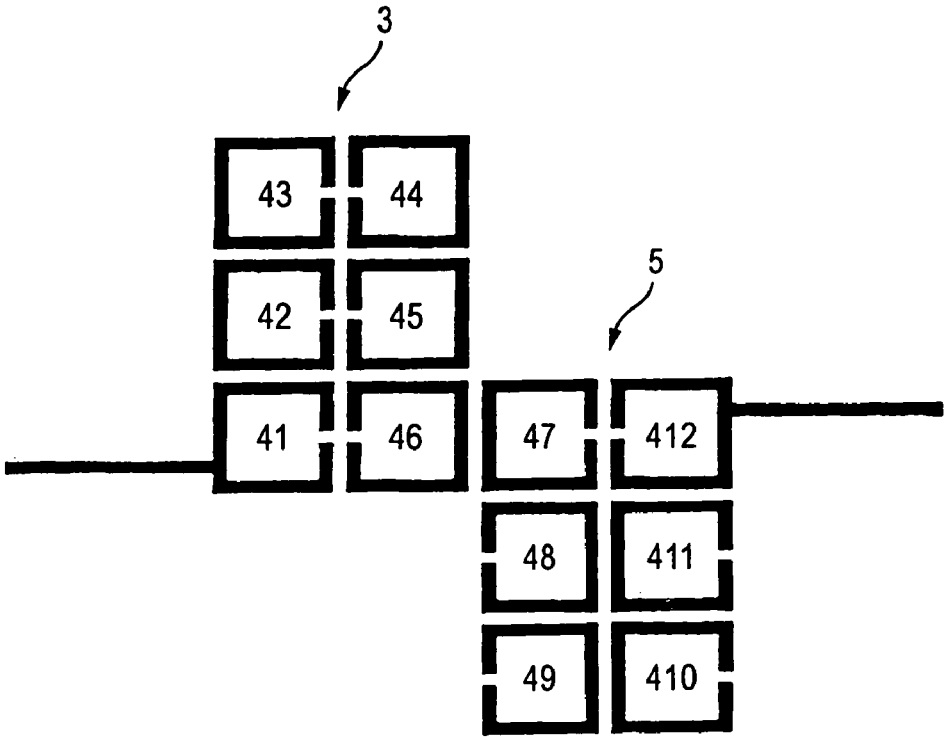
FIG. 8 is a pattern diagram of a filter circuit of a first embodiment of the invention.

FIG. 8 is a diagram illustrating the pattern of a filter of the embodiment.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 41 to 412 are open-loop half-wave resonators.

The resonators 41 to 46 are coupled in this sequence, so that a complex block 3 is configured by the six resonators. The resonators 41 and 46 serve as end resonators of the complex block 3. In FIG. 8, all the couplings between the resonators 41 and 46, the resonators 42 and 45, and the resonators 43 and 44 are electrically realized. Therefore, all the couplings between the resonators 41 and 46, the resonators 42 and 45, and the resonators 43 and 44 are in phase to realize a complex zero of a transfer function. In the embodiment also, all the couplings may be magnetically realized so as to be in phase.

The resonators 47 to 412 are coupled in this sequence, so that a real/pure imaginary block 5 is configured by the six resonators. The resonators 47 and 412 serve as end resonators of the real/pure imaginary block 5. In this example, the resonators 47 and 412 are electrically coupled to each other, and the resonators 48 and 411, and the resonators 49 and 410 are magnetically coupled to each other. The couplings between the resonators 47 and 412, and the resonators 48 and 411 are in an anti-phase relationship with each other. The couplings between the resonators 48 and 411, and the resonators 49 and 410 are in an in-phase relationship with each other.

The anti-phase relationship realizes a pure imaginary zero of a transfer function, and the in-phase relationship realizes a real zero of a transfer function. When the anti-phase and in-phase relationships coexist, the real/pure imaginary block 5 realizes both a real zero and a pure imaginary zero of the transfer function. When only the anti-phase relationship exists, the real/pure imaginary block realizes two pure imaginary zeros of the transfer function. However, zeros due to the real/pure imaginary block 5 can be formed only on the real and imaginary axes of the complex plane, and a complex which is not on the real or imaginary axis cannot be formed as a zero.

In the case of FIG. 8, the real/pure imaginary block 5 has both a pure imaginary zero and a real zero.

The resonators 41 and 412 are connected directly to the external. In FIG. 8, the example in which the resonators 41 and 412 are connected directly to the external is shown. Alternatively, a plurality of resonators which are single-path-coupled are continuously connected to form an exciting portion.

Preferably, the coupling between the resonators 41 and 42 in the complex block 3 is set to be larger than that between the resonators 45 and 46.

When these couplings are equal to each other as in a conventional canonical filter, a disturbed characteristic which has a large ripple in the pass band is obtained. By contrast, in the embodiment, the transfer function is described by the generalized Chebyshev function, and an adjacent coupling between resonators which are close to an input/output port is preferably set to be larger than that between resonators which are remote from an input/output port.

The resonators 46 and 47 are coupled to each other. As a result, the complex block 3 is coupled to the real/pure imaginary block 5. Couplings other than the coupling between the resonators 46 and 47, such as a coupling between the resonators 45 and 47, and that between the resonators 46 and 48 are negligibly weak. FIG. 8 shows the example in which the resonators 46 and 47 are coupled to each other. The resonators 46 and 47 are single-path-coupled to each other. In the coupling between the complex block 3 and the real/pure imaginary block 5, one or more resonators may be arranged so as to attain a single-path coupling.

The fact that couplings other than the coupling between the resonators 46 and 47 are negligible can be ascertained by a circuit simulation in which the filter characteristic in the case where these couplings are considered is not changed from that in the case where these couplings are not considered. By contrast, when a circuit simulation in which the coupling between the resonators 46 and 47 is not considered is performed, it is known that the filter characteristic is extremely disturbed. Therefore, it is proved that the resonators 46 and 47 constitute the main coupling.

When the complex block 3 and the real/pure imaginary block 5 are coupled to each other through two or more portions or spatially coupled, it is difficult to adjust the filter characteristic as in a conventional canonical filter.

Figure 9:
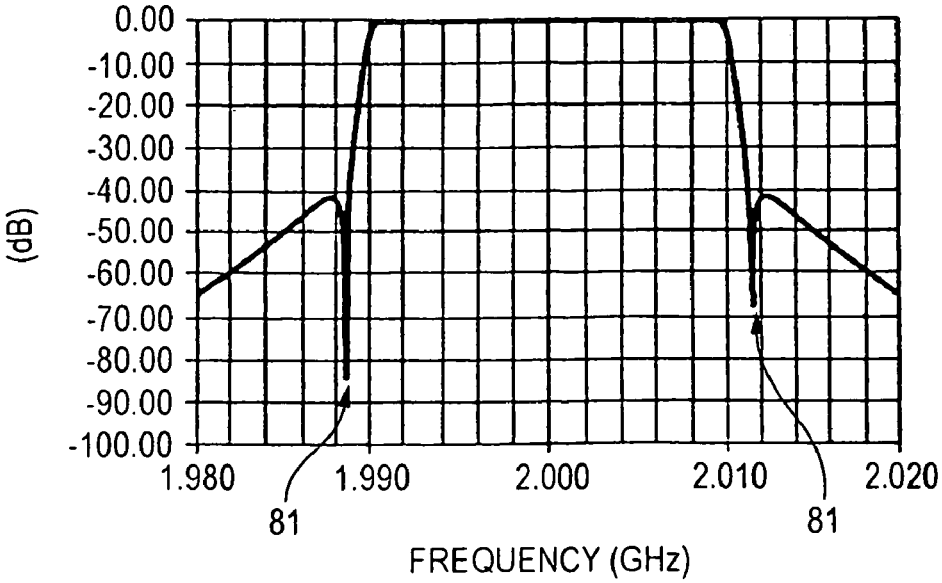
FIG. 9 is a pass amplitude characteristic diagram of the filter circuit according to the first embodiment of the invention.

FIG. 9 shows an example of the pass amplitude characteristic of the filter shown in FIG. 8. In the design, a normalized low-pass filter in which the transfer function has a zero at $\pm(1\pm0.4j)$, $\pm1.2j$, and $\pm0.6$ where j is the imaginary unit was used.

The center frequency is about 2 GHz, and the band width is about 20 MHz. The pass strength is substantially constant in the pass band, and begins to attenuate at frequencies of about 1.99 GHz and 2.01 GHz.

In this example, an attenuation pole 81 due to the pure imaginary zero of the transfer function exists on each of the sides of the pass band, and a steep skirt characteristic is realized.

In the configuration of FIG. 8, the attenuation poles 81 correspond to the number of anti-phases included in the real/pure imaginary block 5. Namely, the attenuation poles correspond to the configuration in which the couplings between the resonators 47 and 412, and the resonators 48 and 411 are in anti-phase, and the couplings between the resonators 48 and 411, and the resonators 49 and 410 are in phase.

Figure 10:
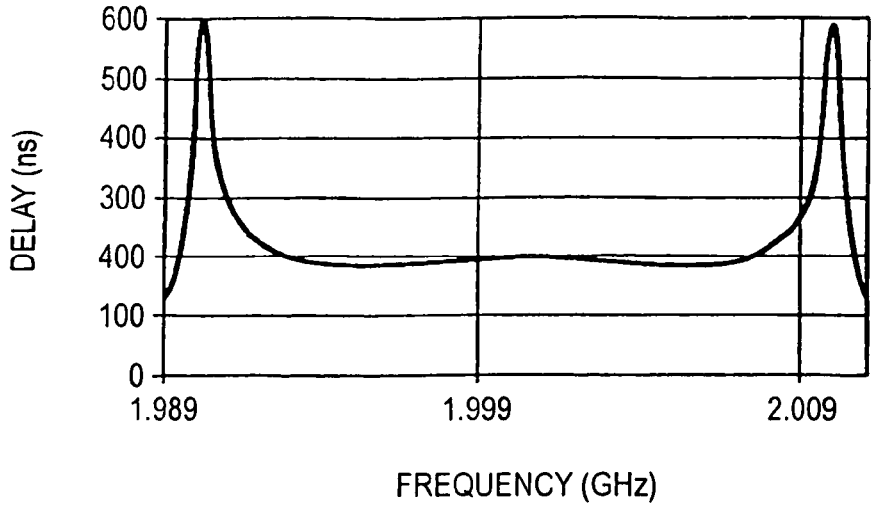
FIG. 10 is a group delay characteristic diagram of the filter circuit according to the first embodiment of the invention.

FIG. 10 shows the group delay characteristic of the filter.

A group delay characteristic which is flat in the pass band is realized by the complex zero and the real zero of the transfer function.

In the embodiment, the resonators are of the open-loop type. Alternatively, various kinds of resonators such as a meander open-loop resonator and a hairpin resonator may be used.

In the embodiment, the circuit is configured by a microstrip line. Alternatively, the circuit may be configured by a strip line. Also in the case of a waveguide filter or a dielectric filter, the filter may be configured in a similar manner. The filter characteristic can be adjusted more easily than in a conventional canonical filter. A superconductor may be employed as a conductor used in the waveguide filter or the dielectric filter.

In the embodiment also, unwanted parasitic couplings can be suppressed with using a plate of a metal such as copper.

In the embodiment, all the couplings between the resonators are determined by the positional relationships among the resonators. Alternatively, a coupling line may be disposed between resonators so as to attain a coupling between them.

(Embodiment 2)

Figure 11:
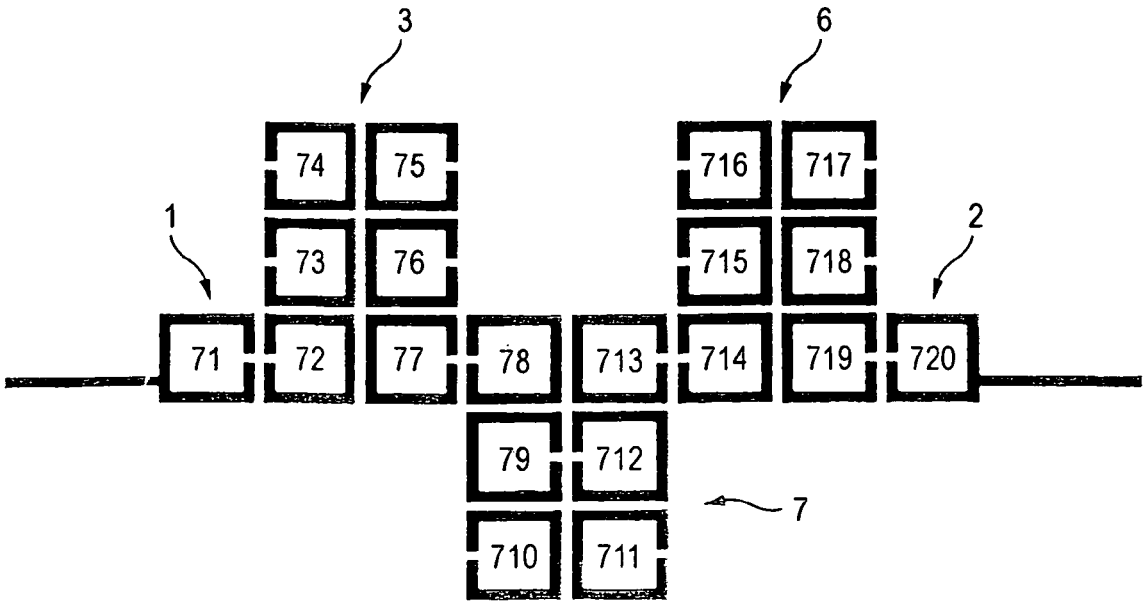
FIG. 11 is a pattern diagram of a filter circuit according to a second embodiment of the invention.

FIG. 11 is a diagram illustrating the pattern of a filter of the embodiment.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 71 to 720 are open-loop half-wave resonators.

The resonators 72 to 77, and the resonators 714 to 719 are sequentially coupled, so that each of complex blocks 3 and 6 is configured by the six corresponding resonators. In the figure, both the complex blocks 3 and 6 include in-phase couplings based on only a magnetic coupling. Both the complex blocks 3 and 6 realize a complex zero of a transfer function. In this case also, in-phase couplings based on to only an electric coupling may be used.

The resonators 78 to 713 are sequentially coupled. In the embodiment, the resonators 78 and 713 are magnetically coupled to each other, the resonators 79 and 712 are electrically coupled to each other, and the resonators 710 and 711 are magnetically coupled to each other. Therefore, the resonators 78 to 713 constitute a real/pure imaginary block 7 including two anti-phases. Pure imaginary zeros of two transfer functions are realized by a coupling of the two anti-phases.

The resonators 77 and 78, and the resonators 713 and 714 are coupled to each other, whereby the complex blocks 3 and 6 are coupled through the real/pure imaginary block 7. Namely, the complex block 3 and the real/pure imaginary block 7 are single-path-coupled, and also the complex block 6 and the real/pure imaginary block 7 are single-path-coupled.

Preferably, the coupling between the resonators 72 and 73 in the complex block 3 is set to be larger than that between the resonators 76 and 77.

When these couplings are equal to each other as in a conventional canonical filter, a disturbed characteristic which has a large ripple in the pass band is obtained. By contrast, in the embodiment, the transfer function is described by the generalized Chebyshev function, and an adjacent coupling between resonators which are close to an input/output port is preferably set to be larger than that between resonators which are remote from an input/output port.

An exciting portion 1 includes the resonator 71, and an exciting portion 2 includes the resonator 720. The resonators 71 and 720 are connected to the external. The resonator 71 is coupled to the resonator 72, and the resonator 720 is coupled to the resonator 719, whereby the exciting portion 1 and the complex block 3 are coupled to each other, and the exciting portion 2 and the complex block 6 are coupled to each other. In this way, the exciting portions 1 and 2 are coupled to each other. In the embodiment also, the exciting portion 1 and the complex block 3 may be single-path-coupled, and the exciting portion 2 and the complex block 6 may be single-path-coupled.

A spatial coupling between the complex blocks 3 and 6 which is performed not through the resonator group of the resonators 78 to 713 may be possible (for example, a coupling between the resonators 75 and 716). However, such a coupling is sufficiently negligible because the distance between the resonators is large. This can be ascertained by a circuit simulation in which the filter characteristic in the case where the coupling is considered is not changed from that in the case where the coupling is not considered.

When an arrangement where the spatial coupling between the complex blocks 3 and 6 which is performed not through the resonator group of the resonators 78 to 713 must be considered is used, it is difficult to adjust the filter characteristic as in a conventional canonical filter.

In the embodiment, in order to reduce the spatial coupling between the complex blocks 3 and 6, the distance between the resonators is made large. Alternatively, the spatial coupling may be reduced by suppressing unwanted parasitic couplings with using a plate of a metal such as copper. All the couplings between the resonators are determined by the positional relationships among the resonators. Alternatively, a coupling line may be disposed between resonators so as to attain a coupling between them.

Figure 12:
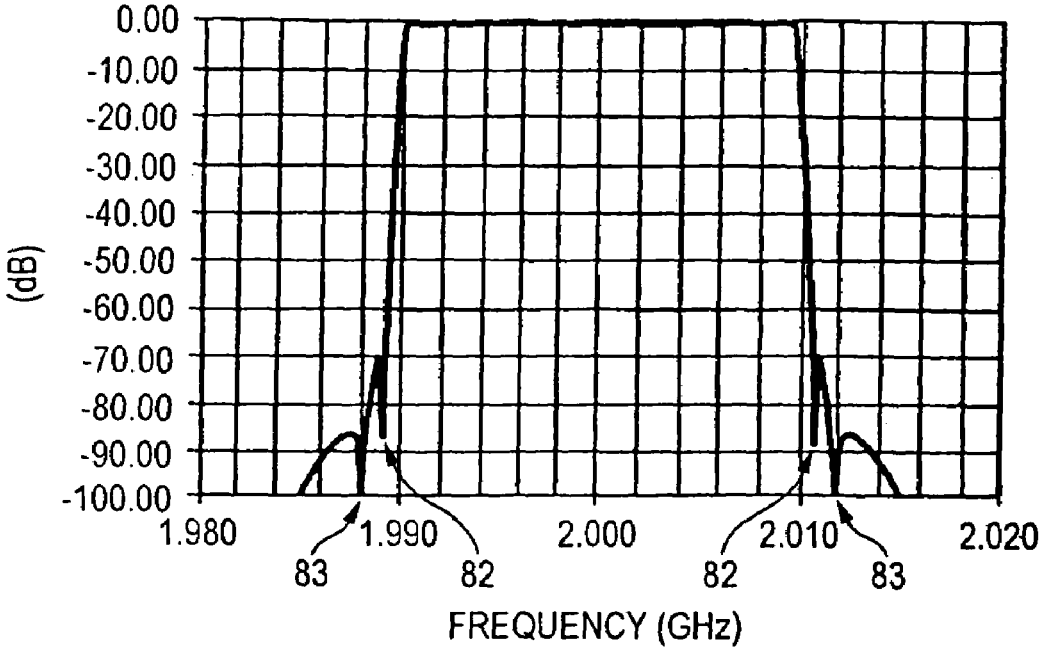
FIG. 12 is a pass amplitude characteristic diagram of the filter circuit according to the second embodiment of the invention.

FIG. 12 shows an example of the pass amplitude characteristic of the filter shown in FIG. 11. In the design, a normalized low-pass filter in which the transfer function has a zero at $\pm(1\pm0.4j)$, $\pm1.1j$, $\pm1.2j$, $\pm0.5$, and $\pm0.6$ where j is the imaginary unit was used. Namely, the figure shows the case where one complex zero is realized by the complex block 3, the real/pure imaginary block 7 reproduces two pure imaginary zeros, and the complex block 6 reproduces two real zeros. The coupling between the resonators 72 and 73 in the complex block 3 is set to be larger than that between the resonators 76 and 77.

The center frequency is about 2 GHz, and the band width is about 20 MHz. Two attenuation poles 82, 83 due to the two pure imaginary zeros of the transfer function exist on each of the sides of the pass band, and a steep skirt characteristic is realized. Namely, a desired pass characteristic is realized without being disturbed by unwanted parasitic couplings.

Figure 13:
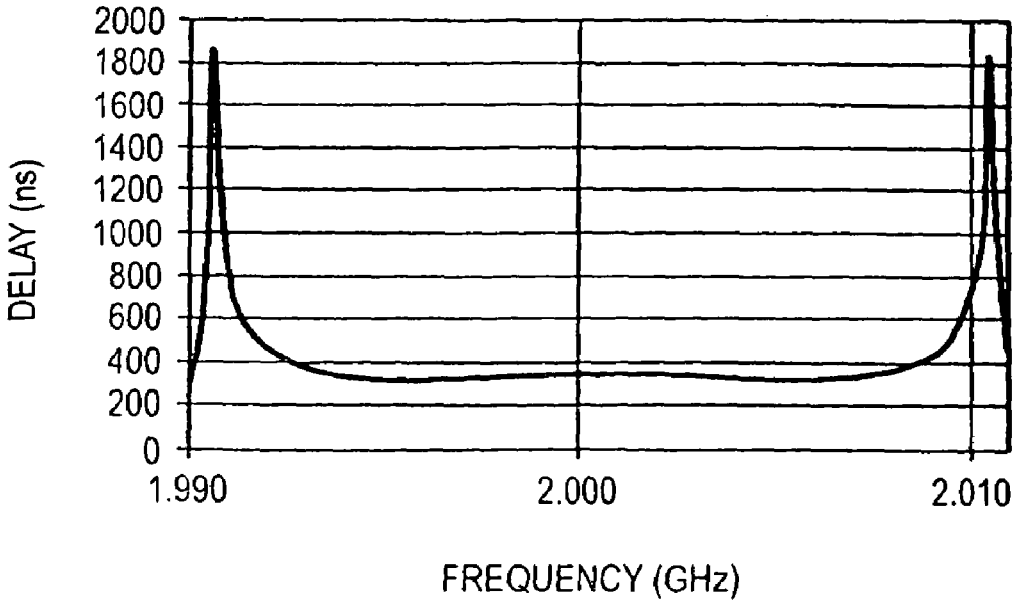
FIG. 13 is a group delay characteristic diagram of the filter circuit according to the second embodiment of the invention.

FIG. 13 shows the group delay characteristic of the filter.

A group delay characteristic which is flat in the pass band is realized by the complex zero and the real zero of the transfer function.

In the embodiment, the resonators are of the open-loop type. Alternatively, various kinds of resonators such as a meander open-loop resonator and a hairpin resonator may be used.

In the embodiment, the circuit is configured by a microstrip line. Alternatively, the circuit may be configured by a strip line. Also in the case of a waveguide filter or a dielectric filter, the filter may be configured in a similar manner. The filter characteristic can be adjusted more easily than in a conventional canonical filter. A superconductor may be employed as a conductor used in the waveguide filter or the dielectric filter.

In the embodiment, the example in which two complex blocks and one real/pure imaginary block are used has been described. Alternatively, in accordance with the necessity of a zero of a transfer function, a further complex block(s) may be disposed, or a real/pure imaginary block(s) may be added.

(Embodiment 3)

Figure 14:
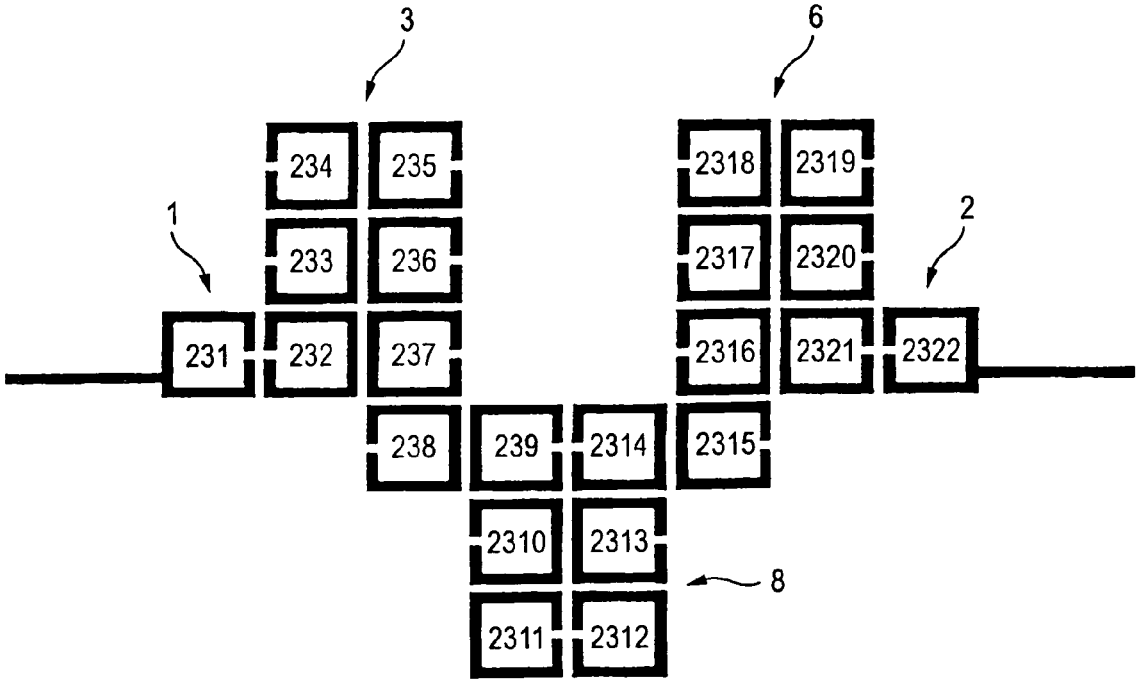
FIG. 14 is a pattern diagram of a filter circuit according to a third embodiment of the invention.

FIG. 14 is a diagram illustrating the pattern of a filter of the embodiment.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 231 to 2322 are open-loop half-wave resonators.

The resonators 232 to 237 are sequentially coupled, so that a complex block 3 is configured by the six resonators.

The resonators 2316 to 2321 are sequentially coupled, so that a complex block 6 is configured by the six resonators.

In the figure, both the complex blocks 3 and 6 include in-phase couplings based on only a magnetic coupling. In the embodiment also, in-phase couplings based on only an electric coupling may be used.

The complex blocks 3 and 6 are identical in structure with each other. Depending on the design, in each of the blocks, one complex zero of a transfer function may be realized, or two real zeros of a transfer function may be realized.

The resonators 239 to 2314 are sequentially coupled, so that a real/pure imaginary block 8 is configured by the six resonators. In the embodiment, the resonators 239 and 2314 are electrically coupled to each other, the resonators 2310 and 2313 are magnetically coupled to each other, and the resonators 2311 and 2312 are electrically coupled to each other. Therefore, the real/pure imaginary block 8 serves as a resonator group including two anti-phases. Pure imaginary zeros of two transfer functions are realized by a coupling of the two anti-phases.

The resonators 237 and 239 are coupled to each other through the resonator 238, and the resonators 2314 and 2316 are coupled to each other through the resonator 2315. As a result, the complex blocks 3 and 6 are single-path-coupled through the real/pure imaginary block 8. Namely, the complex block 3 and the real/pure imaginary block 8 are single-path-coupled, and also the complex block 6 and the real/pure imaginary block 8 are single-path-coupled. In the embodiment, the example in which the complex block 3 and the real/pure imaginary block 8 are coupled through the single resonator 238 is shown. Alternatively, the blocks may be single-path-coupled through a further resonator(s). This is similarly applicable also to the coupling between the complex block 6 and the real/pure imaginary block 8.

In the embodiment also, preferably, the coupling between the resonators 232 and 233 in the complex block 3 is set to be larger than that between the resonators 236 and 237.

An exciting portion 1 includes the resonator 231, and an exciting portion 2 includes the resonator 2322. The resonators 231 and 2322 are connected to the external. The resonator 231 is coupled to the resonator 232, and the resonator 2322 is coupled to the resonator 2321, whereby the exciting portion 1 and the complex block 3 are coupled to each other, and the exciting portion 2 and the complex block 6 are coupled to each other. In this way, the exciting portions 1 and 2 are coupled to each other. In the embodiment also, the exciting portion 1 and the complex block 3 may be single-path-coupled, and the exciting portion 2 and the complex block 6 may be single-path-coupled.

Figure 15:
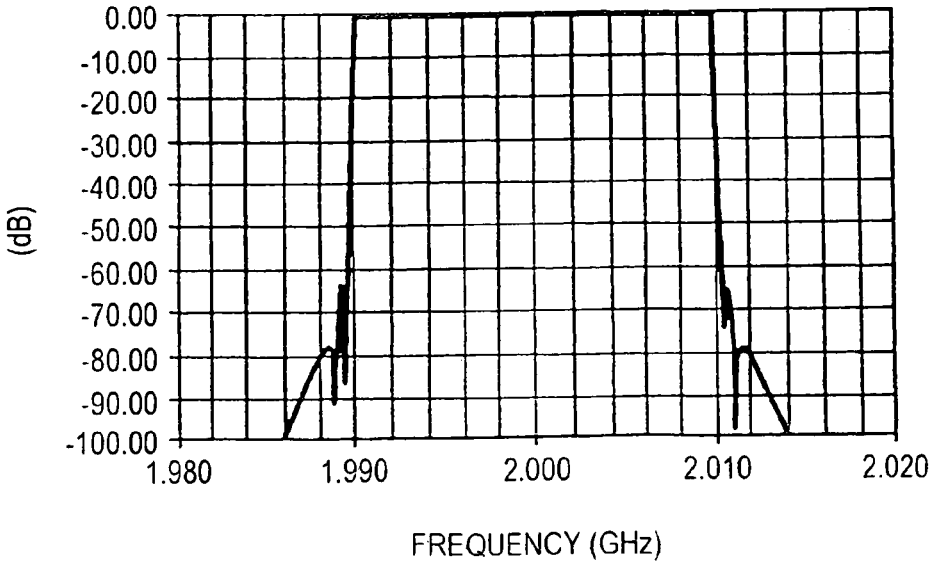
FIG. 15 is a pass amplitude characteristic diagram of the filter circuit according to the third embodiment of the invention.

FIG. 15 shows an example of the pass amplitude characteristic of the filter shown in FIG. 14. In the design, a normalized low-pass filter in which the transfer function has a zero at ±(1±0.4j), ±1.06j, ±1.12j, ±0.5, and ±0.6 where j is the imaginary unit was used. Namely, the figure shows the case where one complex zero is realized by the complex block 3, the complex block 6 reproduces two real zeros, and the real/pure imaginary block 8 reproduces two pure imaginary zeros.

The center frequency is about 2 GHz, and the band width is about 20 MHz. Two attenuation poles due to the two pure imaginary zeros of the transfer function exist on each of the sides of the pass band, and a steep skirt characteristic is realized. Namely, a desired pass characteristic is realized without being disturbed by unwanted parasitic couplings.

Figure 16:
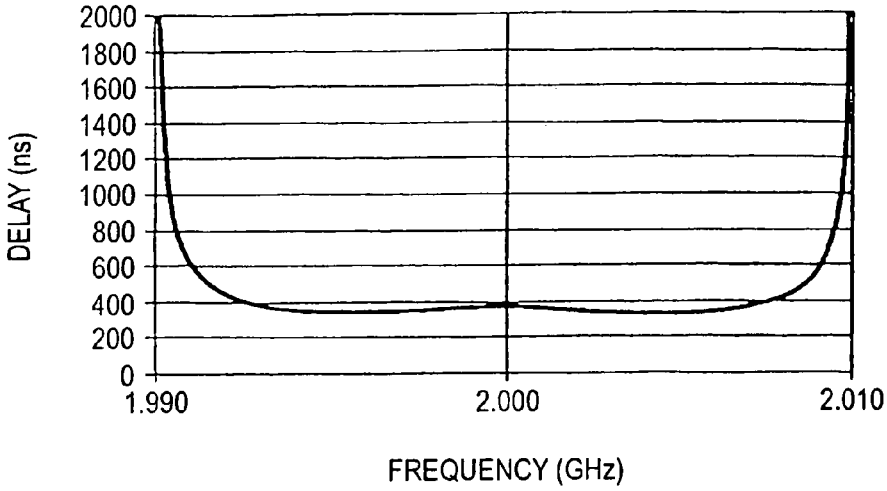
FIG. 16 is a group delay characteristic diagram of the filter circuit according to the third embodiment of the invention.

FIG. 16 shows the group delay characteristic of the filter. A group delay characteristic which is flat in the pass band is realized by the complex zero and the real zero of the transfer function.

In the embodiment, the resonators are of the open-loop type. Alternatively, various kinds of resonators such as a meander open-loop resonator and a hairpin resonator may be used.

In the embodiment, the circuit is configured by a microstrip line. Alternatively, the circuit may be configured by a strip line. Also in the case of a waveguide filter or a dielectric filter, the filter may be configured in a similar manner. The filter characteristic can be adjusted more easily than in a conventional canonical filter. A superconductor may be employed as a conductor used in the waveguide filter or the dielectric filter.

(Embodiment 4)

Figure 17:
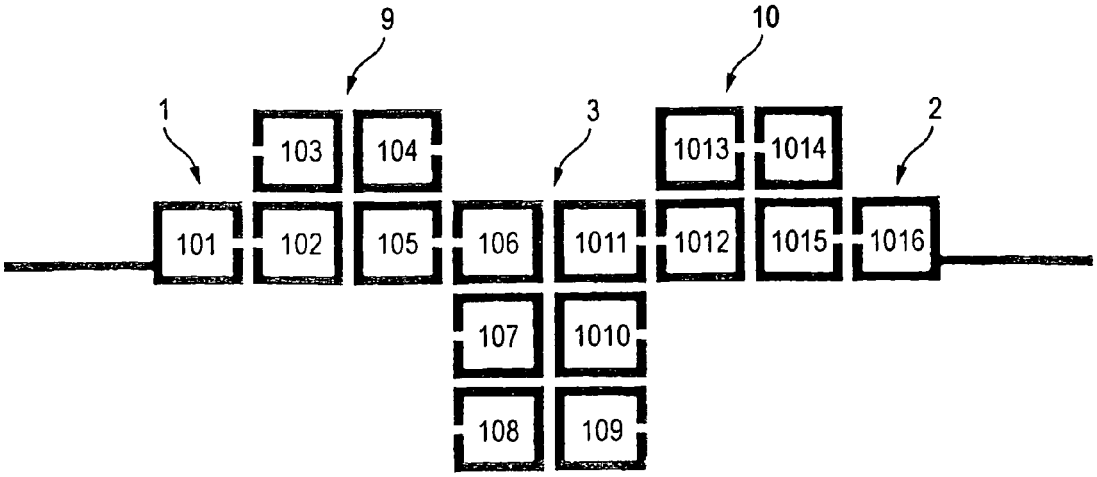
FIG. 17 is a pattern diagram of a filter circuit according to a fourth embodiment of the invention.

FIG. 17 is a diagram illustrating the pattern of a filter of the embodiment.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 101 to 1016 are open-loop half-wave resonators.

The resonators 106 to 1011 are sequentially coupled, so that a complex block 3 is configured by six resonators. All couplings between the resonators 106 and 1011, the resonators 107 and 1010, and the resonators 108 and 109 are configured by magnetic couplings. Therefore, these couplings are in phase, and the complex block 3 realizes a complex zero of a transfer function. In the embodiment also, all the couplings may be electrically realized so as to be in phase.

The resonators 102 to 105 are coupled in this sequence, so that a real block 9 is configured by the four resonators. Both the couplings between the resonators 102 and 105, and between the resonators 103 and 104 are magnetically realized, and in phase. The real block 9 realizes one real zero of a transfer function. In the embodiment, the real block 9 in which the couplings are configured by magnetic couplings in phase is shown. In the real block 9, it is requested only that the couplings are in phase. Therefore, the couplings may include electric couplings in phase.

The resonators 1012 to 1015 are coupled in this sequence, so that a pure imaginary block 10 is configured by the four resonators. The coupling between the resonators 1012 and 1015 is magnetically realized, and that between the resonators 1013 and 1014 is electrically realized. Namely, the pure imaginary block 10 includes an anti-phase. The pure imaginary block 10 realizes one pure imaginary zero of a transfer function. Since the pure imaginary block 10 is requested only to include an anti-phase, the coupling between the resonators 1012 and 1015 may be electrically realized, and that between the resonators 1013 and 1014 may be magnetically realized, so as to attain an anti-phase.

An exciting portion 1 includes the resonator 101, and an exciting portion 2 includes the resonator 1016. The resonators 101 and 1016 are connected to the external. The exciting portion 1 and the real block 9 are coupled to each other through a coupling between the resonators 101 and 102. The exciting portion 2 and the pure imaginary block 10 are coupled to each other through a coupling between the resonator 1015 and the resonator 1016. In the embodiment also, each of the couplings between the exciting portion 1 and the real block 9, and the exciting portion 2 and the pure imaginary block 10 is requested to be performed through a single path.

The real block 9 and the complex block 3 are coupled to each other through a coupling between the resonators 105 and 106, and the complex block 3 and the pure imaginary block 10 are coupled to each other through a coupling between the resonator 1011 and the resonator 1012.

In the embodiment also, an adjacent coupling between resonators which are close to an input/output port is preferably set to be larger than that between resonators which are remote from an input/output port.

A coupling between the real block 9 and the pure imaginary block 10 which is performed not through the complex block 3 but through a space may be possible (for example, a coupling between the resonators 104 and 1013). However, such a coupling is negligible because the distance between the resonators is large.

The fact that the coupling between the exciting portions 1 and 2 through a space is negligible can be ascertained by a circuit simulation in which the filter characteristic in the case where the coupling is considered is not changed from that in the case where the coupling is not considered.

When a coupling which is performed not through the complex block 3, such as that between the exciting portions 1 and 2, or that between the real block 9 and the pure imaginary block 10 is added, it is difficult to adjust the filter characteristic as in a conventional canonical filter.

In the embodiment, the distance between the exciting portions 1 and 2 is set to be large in order to reduce the coupling between the exciting portions 1 and 2 which is performed not through the complex block 3. For example, unwanted parasitic couplings may be suppressed with using a plate of a metal such as copper.

All the couplings between the resonators are determined by the positional relationships among the resonators. Alternatively, a coupling line may be disposed between resonators so as to attain a coupling between them.

Figure 18:
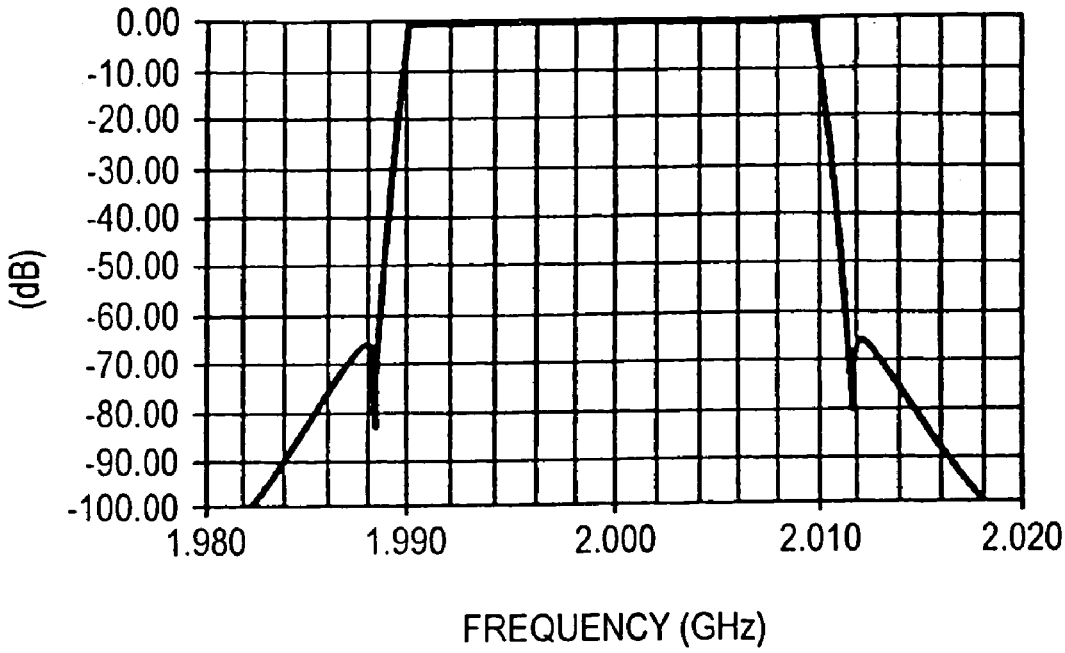
FIG. 18 is a pass amplitude characteristic diagram of the filter circuit according to the fourth embodiment of the invention.

FIG. 18 shows an example of the pass amplitude characteristic of the filter shown in FIG. 17. In the design, a normalized low-pass filter in which the transfer function has a zero at $\pm(1\pm0.4j)$, $\pm1.2j$, and $\pm0.6$ where j is the imaginary unit was used.

In the embodiment, in order to describe a complex zero of a transfer function, the complex block 3 is used, a real zero is described by the real block 9, and a pure imaginary zero is described by the pure imaginary block 10.

The center frequency is about 2 GHz, and the band width is about 20 MHz.

One attenuation pole due to the pure imaginary zero of the transfer function exists on each of the sides of the pass band, and a steep skirt characteristic is realized. Namely, a desired pass characteristic is realized without being disturbed by unwanted parasitic couplings.

Figure 19:
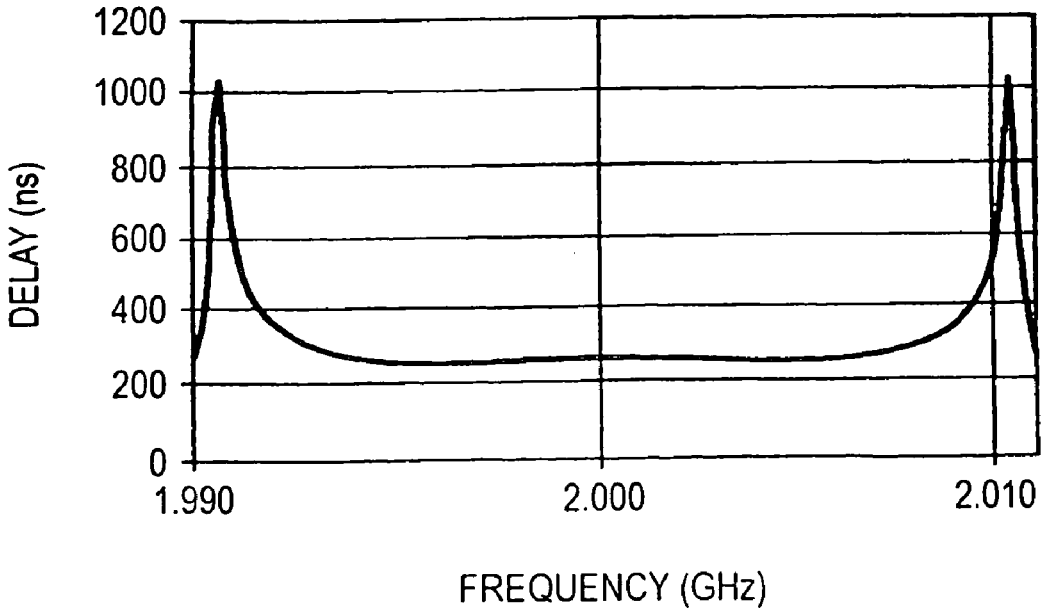
FIG. 19 is a group delay characteristic diagram of the filter circuit according to the fourth embodiment of the invention.

FIG. 19 shows the group delay characteristic.

A group delay characteristic which is flat in the pass band is realized by the complex zero and the real zero of the transfer function.

In the embodiment, the resonators are of the open-loop type. Alternatively, various kinds of resonators such as a meander open-loop resonator and a hairpin resonator may be used.

In the embodiment, the circuit is configured by a microstrip line. Alternatively, the circuit may be configured by a strip line. Also in the case of a waveguide filter or a dielectric filter, the filter may be configured in a similar manner. The filter characteristic can be adjusted more easily than in a conventional canonical filter. A superconductor may be employed as a conductor used in the waveguide filter or the dielectric filter.

In the embodiment, the example in which a complex block, a real block, and a pure imaginary block are used has been described. Alternatively, in accordance with the necessity of a zero of a transfer function, a filter which is configured by only a complex block and a real block, or that which is configured by only a complex block and a pure imaginary block may be used. Moreover, a filter which is configured by a complex block and a plurality of real blocks or pure imaginary blocks, or that which is configured by a plurality of complex blocks and a plurality of real blocks or pure imaginary blocks may be used.

Figure 29:
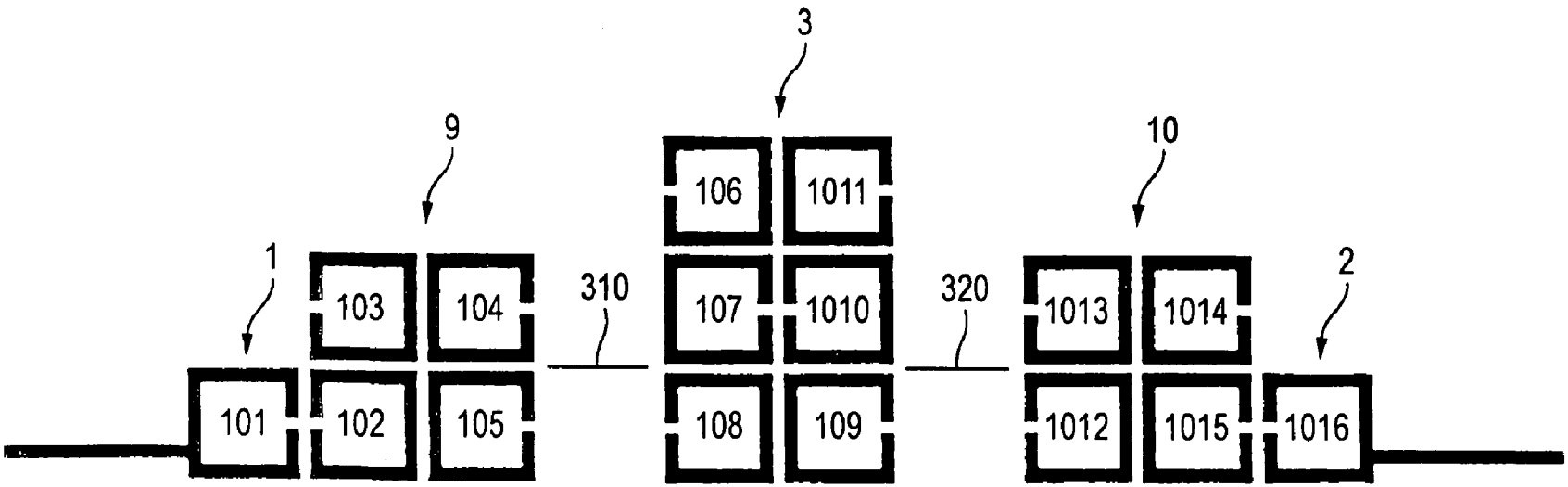
FIG. 29 is another example of a pattern diagram of a filter circuit according to a fourth embodiment of the invention.

In the embodiment, as shown in FIG. 29, a first single path circuit 310 and a second single circuit 320 may be intervened between the real block 9 and the complex block 3, and between the complex block 3 and the real complex block 10, respectively. In this case, the first single path circuit 310 couples the real block 9 with the complex block via a single path. The second single path circuit 320 couples the complex block 3 with the real complex block 10 via a single path.

(Embodiment 5)

Figure 20:
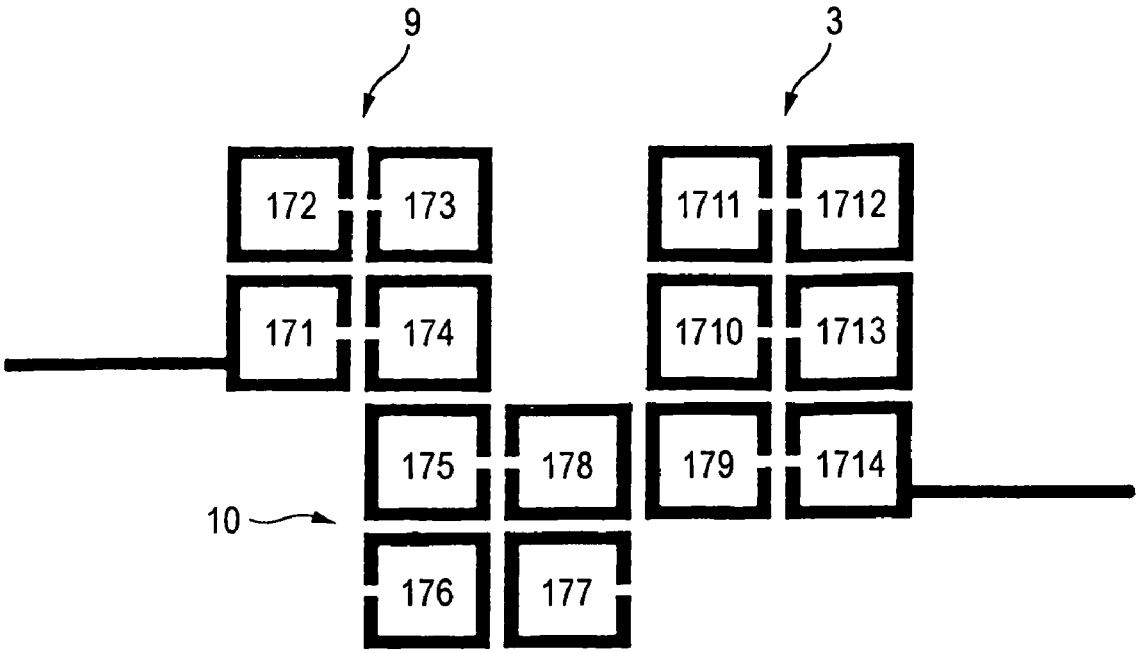
FIG. 20 is a pattern diagram of a filter circuit according to a fifth embodiment of the invention.

FIG. 20 is a diagram illustrating the pattern of a filter of the embodiment.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 171 to 1714 are open-loop half-wave resonators.

The resonators 179 to 1714 are sequentially coupled, so that a complex block 3 is configured by six resonators. All couplings between the resonators 179 and 1714, the resonators 1710 and 1713, and the resonators 1711 and 1712 are configured by electric couplings. Therefore, these couplings are in phase, and the complex block 3 realizes a complex zero of a transfer function. In the embodiment also, all the couplings may be magnetically realized so as to be in phase.

In the embodiment also, an adjacent coupling between resonators which are close to an input/output port is preferably set to be larger than that between resonators which are remote from an input/output port.

The resonators 171 to 174 are coupled in this sequence, so that a real block 9 is configured by the four resonators. Both the couplings between the resonators 171 and 174, and between the resonators 172 and 173 are electrically realized. Namely, the couplings are in phase, and realize a real zero of a transfer function.

The resonators 175 to 178 are coupled in this sequence, so that a pure imaginary block 10 is configured by the four resonators. The resonators 175 and 178 are electrically coupled, and the resonators 176 and 177 are magnetically coupled. Namely, the couplings are in anti-phase, and realize a pure imaginary zero of a transfer function.

The real block 9 and the pure imaginary block 10 are coupled to each other through a coupling between the resonators 174 and 175. The pure imaginary block 10 and the complex block 3 are coupled to each other through a coupling between the resonators 178 and 179. Therefore, the real block 9 and the pure imaginary block 10 are single-path-coupled to each other, and the pure imaginary block 10 and the complex block 3 are single-path-coupled to each other.

The blocks are quested only to be single-path-coupled, and may be arbitrarily arranged.

In FIG. 20, the resonators 171 and 1714 are connected directly to the external. In the embodiment also, a resonator may be disposed between the external and the resonator 171, or between the external and the resonator 1714 so as to attain a single-path coupling.

A coupling between the real block 9 or the pure imaginary block 10 and the complex block 3 which is performed not through the coupling between the resonators 178 and 179 but through a space may be possible (for example, a coupling between the resonators 173 and 1711). However, such a coupling is negligible because the distance between the resonators is large.

The fact that the coupling between the real block 9 or the pure imaginary block 10 and the complex block 3 through a space is negligible can be ascertained by a circuit simulation in which the filter characteristic in the case where the coupling is considered is not changed from that in the case where the coupling is not considered.

When a coupling between the real block 9 or the pure imaginary block 10 and the complex block 3 through a space is added, it is difficult to adjust the filter characteristic as in a conventional canonical filter.

In the embodiment, the distances between the real block 9 and the pure imaginary block 10, and the complex block 3 are set to be large in order to reduce the couplings between the blocks through a space. For example, unwanted parasitic couplings may be suppressed with using a plate of a metal such as copper.

All the couplings between the resonators are determined by the positional relationships among the resonators. Alternatively, a coupling line may be disposed between resonators so as to attain a coupling between them.

Figure 21:
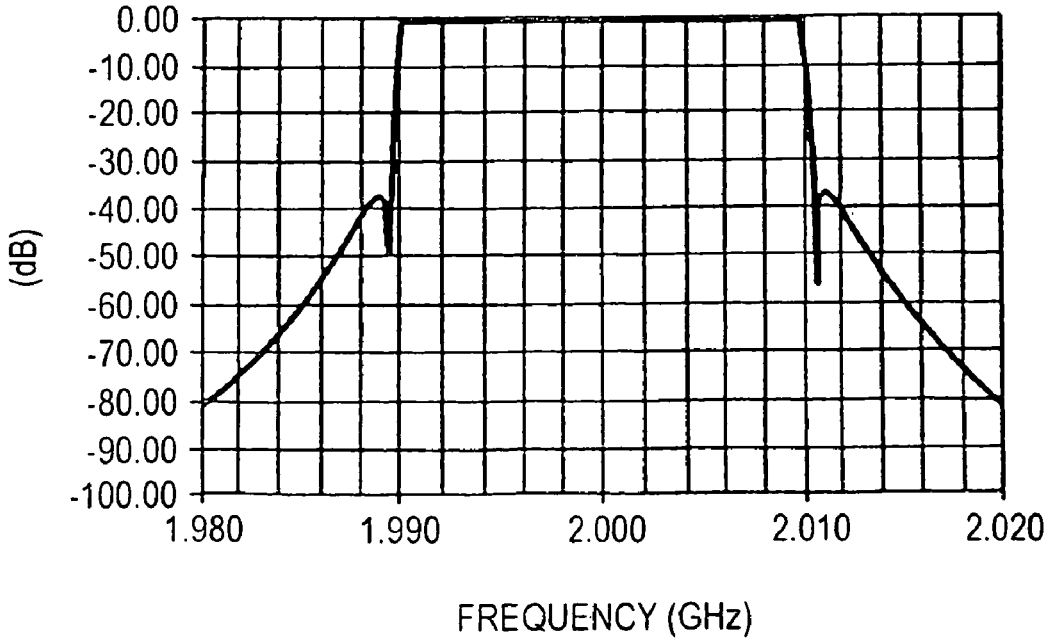
FIG. 21 is a pass amplitude characteristic diagram of the filter circuit according to the fifth embodiment of the invention.

FIG. 21 shows an example of the pass amplitude characteristic of the filter shown in FIG. 20. In the design, a normalized low-pass filter in which the transfer function has a zero at $\pm(0.7\pm0.7j)$, $\pm1.1j$, and $\pm0.65$ where j is the imaginary unit was used.

In the embodiment, in order to describe a complex zero of a transfer function, the complex block 3 is used, a real zero is described by the real block 9, and a pure imaginary zero is described by the pure imaginary block 10.

The center frequency is about 2 GHz, and the band width is about 20 MHz.

One attenuation pole due to the pure imaginary zero of the transfer function exists on each of the sides of the pass band, and a steep skirt characteristic is realized. Namely, a desired pass characteristic is realized without being disturbed by unwanted parasitic couplings.

Figure 22:
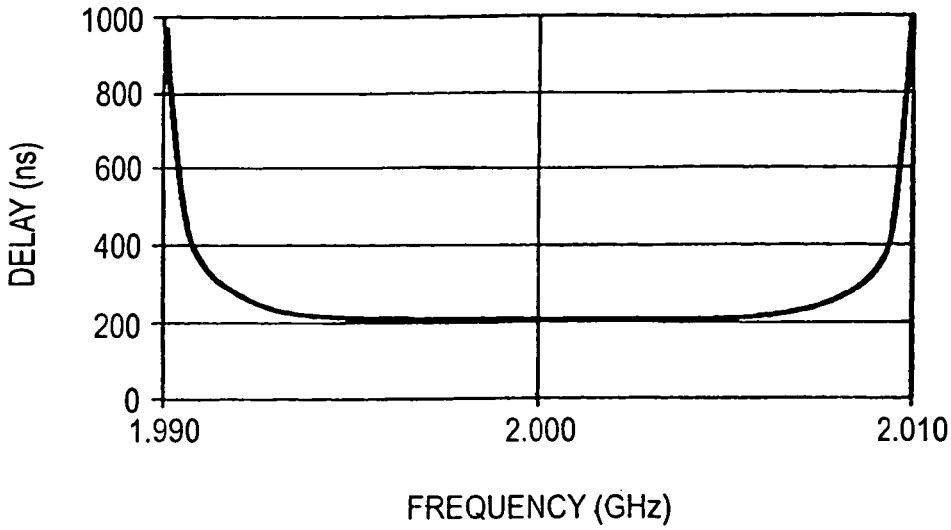
FIG. 22 is a group delay characteristic diagram of the filter circuit according to the fifth embodiment of the invention.

FIG. 22 shows the group delay characteristic.

A group delay characteristic which is flat in the pass band is realized by the complex zero and the real zero of the transfer function.

In the embodiment, the resonators are of the open-loop type. Alternatively, various kinds of resonators such as a meander open-loop resonator and a hairpin resonator may be used.

In the embodiment, the circuit is configured by a microstrip line. Alternatively, the circuit may be configured by a strip line. Also in the case of a waveguide filter or a dielectric filter, the filter may be configured in a similar manner. The filter characteristic can be adjusted more easily than in a conventional canonical filter. A superconductor may be employed as a conductor used in the waveguide filter or the dielectric filter.

(Embodiment 6)

Figure 23:
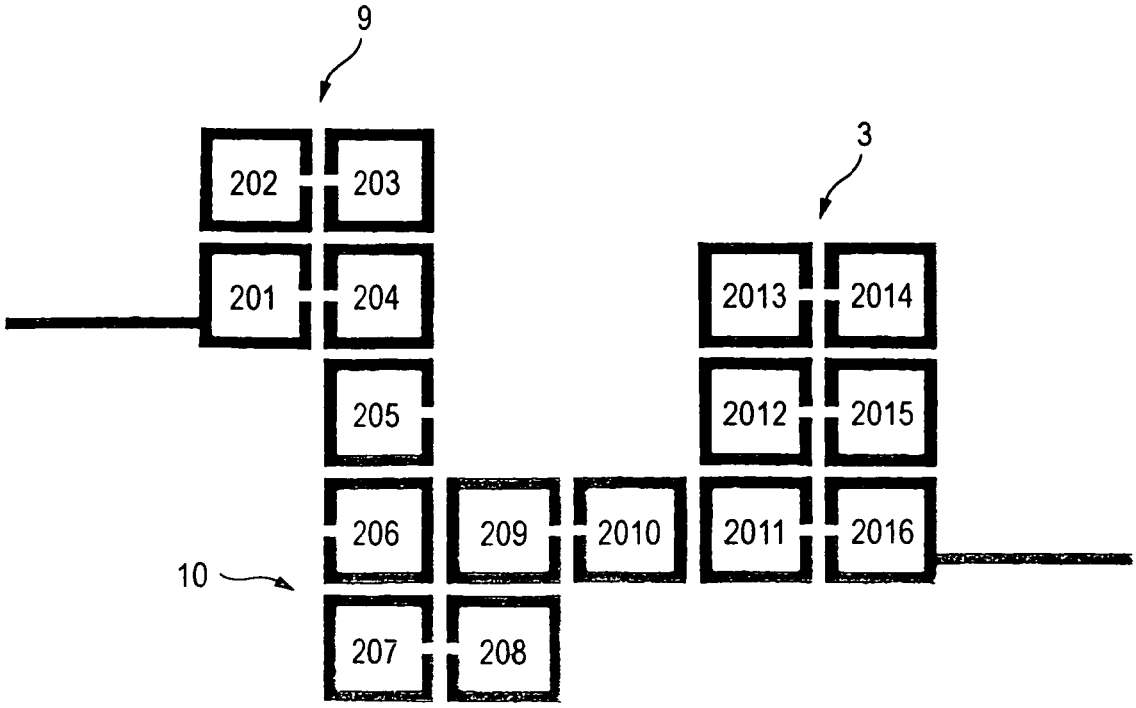
FIG. 23 is a pattern diagram of a filter circuit according to a sixth embodiment of the invention.

FIG. 23 is a diagram illustrating the pattern of a filter of the embodiment.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 201 to 2016 are open-loop half-wave resonators.

The resonators 2011 to 2016 are sequentially coupled, so that a complex block 3 is configured by the six resonators. All couplings between the resonators 2011 and 2016, the resonators 2012 and 2015, and the resonators 2013 and 2014 are configured by electric couplings. Therefore, these couplings are in phase, and the complex block 3 realizes a complex zero of a transfer function. In the embodiment also, all the couplings may be magnetically realized so as to be in phase.

In the embodiment also, an adjacent coupling between resonators which are close to an input/output port is preferably set to be larger than that between resonators which are remote from an input/output port.

The resonators 201 to 204 are coupled in this sequence, so that a real block 9 is configured by the four resonators. Both the couplings between the resonators 201 and 204, and between the resonators 202 and 203 are electrically realized. Namely, the couplings are in phase, and realize a real zero of a transfer function. In the embodiment also, the couplings may be magnetically realized so as to be in phase.

The resonators 206 to 209 are coupled in this sequence, so that a pure imaginary block 10 is configured by the four resonators. The resonators 206 and 209 are magnetically coupled, and the resonators 207 and 208 are electrically coupled. Namely, the couplings are in anti-phase, and realize a pure imaginary zero of a transfer function.

The resonators 201 and 2016 are connected directly to the external. In the embodiment also, a resonator may be disposed between the external and the resonator 201, or between the external and the resonator 2016 so as to attain a single-path coupling.

The real block 9 and the pure imaginary block 10 are single-path coupled through the resonator 205. In the embodiment, the coupling through the single resonator 205 is exemplarily shown. Alternatively, a single-path coupling may be configured with interposing a plurality of blocks.

Similarly, the pure imaginary block 10 and the complex block 3 are single-path coupled through the resonator 2010. Also in this case, a single-path coupling due to a plurality of blocks may be configured.

A coupling between the blocks which is performed not through the coupling between the resonators 2010 and 2011 but through a space may be possible (for example, a coupling between the resonators 204 and 2013). However, such a coupling is negligible because the distance between the resonators is large.

The fact that a coupling between the blocks through a space is negligible can be ascertained by a circuit simulation in which the filter characteristic in the case where the coupling is considered is not changed from that in the case where the coupling is not considered.

When a coupling between the blocks through a space is added, it is difficult to adjust the filter characteristic as in a conventional canonical filter.

In the embodiment, the distances between the blocks are set to be large in order to reduce the couplings between the blocks through a space. For example, unwanted parasitic couplings may be suppressed with using a plate of a metal such as copper.

All the couplings between the resonators are determined by the positional relationships among the resonators. Alternatively, a coupling line may be disposed between resonators so as to attain a coupling between them.

Figure 24:
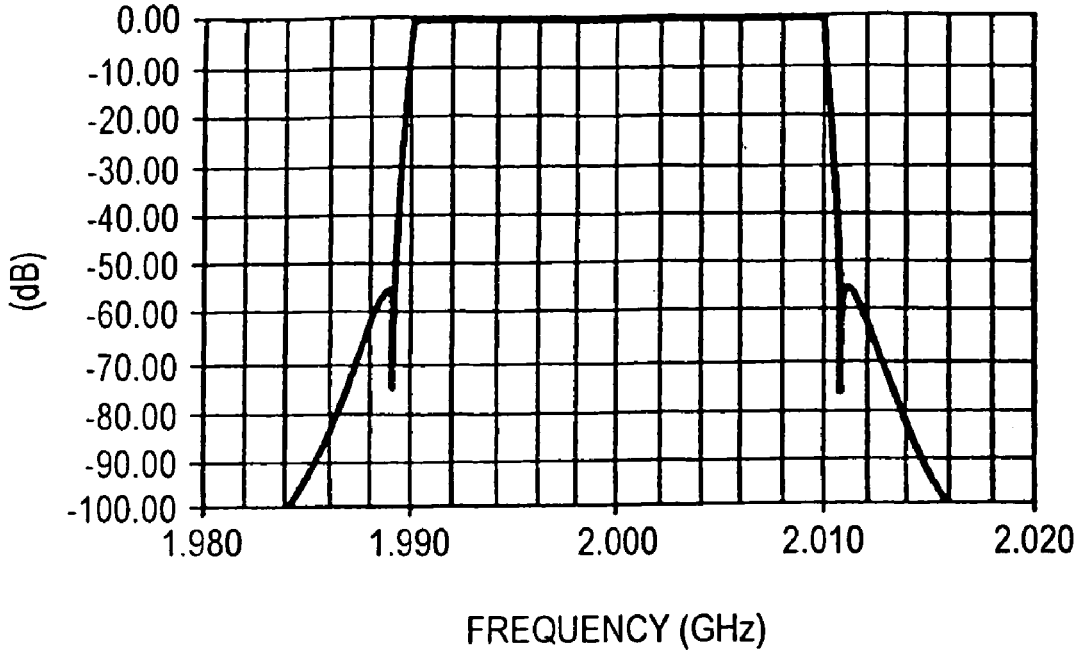
FIG. 24 is a pass amplitude characteristic diagram of the filter circuit according to the sixth embodiment of the invention.

FIG. 24 shows an example of the pass amplitude characteristic of the filter shown in FIG. 23. In the design, a normalized low-pass filter in which the transfer function has a zero at ±(0.7±0.7j), ±1.1j, and ±0.65 where j is the imaginary unit was used.

In the embodiment, in order to describe a complex zero of a transfer function, the complex block 3 is used, a real zero is described by the real block 9, and a pure imaginary zero is described by the pure imaginary block 10.

The center frequency is about 2 GHz, and the band width is about 20 MHz.

One attenuation pole due to the pure imaginary zero of the transfer function exists on each of the sides of the pass band, and a steep skirt characteristic is realized. Namely, a desired pass characteristic is realized without being disturbed by unwanted parasitic couplings.

Figure 25:
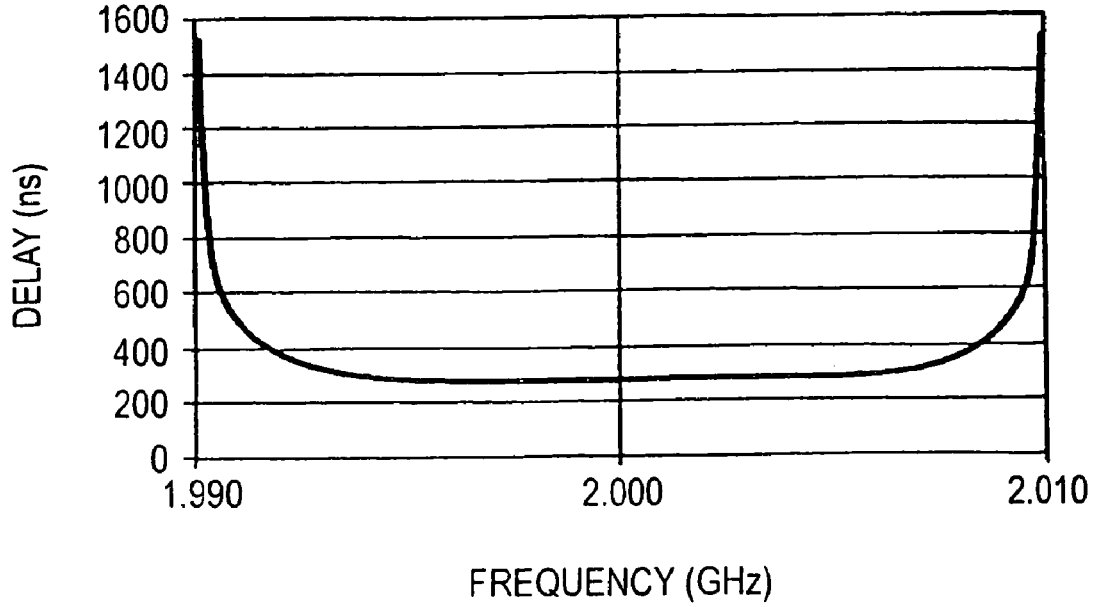
FIG. 25 is a group delay characteristic diagram of the filter circuit according to the sixth embodiment of the invention.

FIG. 25 shows the group delay characteristic.

A group delay characteristic which is flat in the pass band is realized by the complex zero and the real zero of the transfer function.

In the embodiment, the resonators are of the open-loop type. Alternatively, various kinds of resonators such as a meander open-loop resonator and a hairpin resonator may be used.

In the embodiment, the circuit is configured by a microstrip line. Alternatively, the circuit may be configured by a strip line. Also in the case of a waveguide filter or a dielectric filter, the filter may be configured in a similar manner. The filter characteristic can be adjusted more easily than in a conventional canonical filter. A superconductor may be employed as a conductor used in the waveguide filter or the dielectric filter.

(Embodiment 7)

Figure 26:
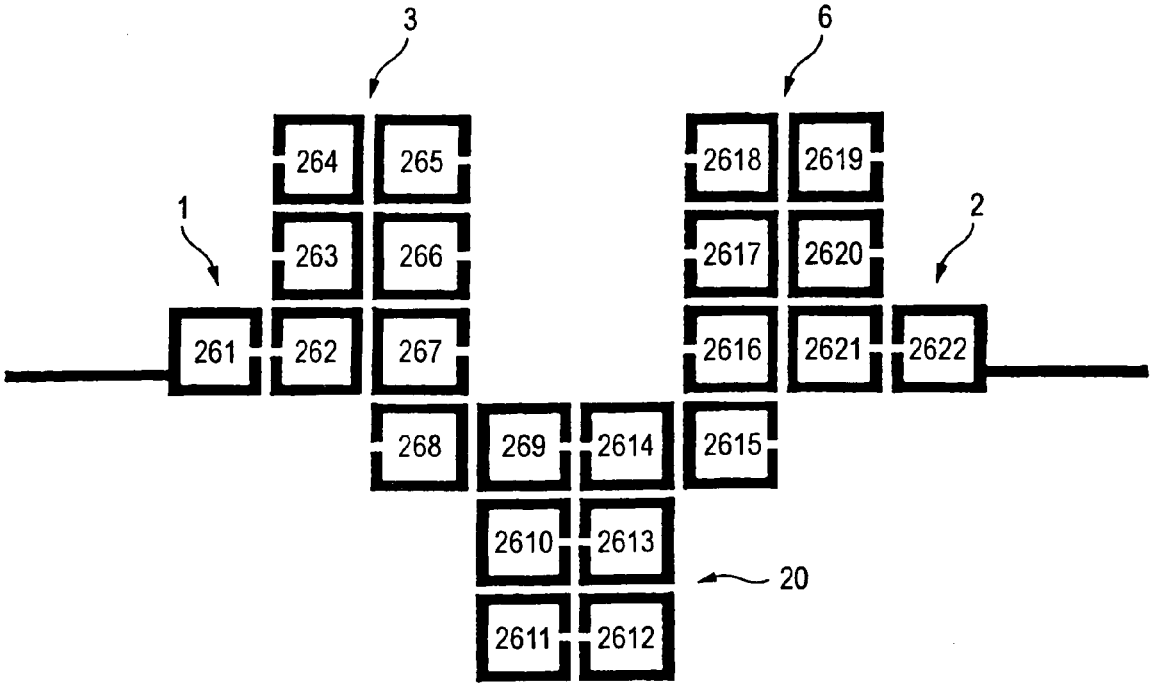
FIG. 26 is a pattern diagram of a filter circuit according to a seventh embodiment of the invention.

FIG. 26 is a diagram illustrating the pattern of a filter of the embodiment.

A superconductor microstrip line filter is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 261 to 2622 are open-loop half-wave resonators.

The resonators 262 to 267 are sequentially coupled, so that a complex block 3 is configured by the six resonators.

The resonators 2616 to 2621 are sequentially coupled, so that a complex block 6 is configured by the six resonators.

The resonators 269 to 2614 are sequentially coupled, so that a complex block 20 is configured by six resonators.

In the figure, both the complex blocks 3 and 6 include in-phase couplings based on only a magnetic coupling. In this case also, in-phase couplings based on only an electric coupling may be used.

The complex block 20 includes in-phase couplings based on only an electric coupling. In this case also, in-phase couplings based on only a magnetic coupling may be used.

The complex blocks 3, 6, and 20 are identical in structure with one other. Depending on the design, in each of the blocks, one complex zero of a transfer function may be realized, or two real zeros of a transfer function may be realized. Alternatively, a complex zero and a real zero of a transfer function may be realized.

In the embodiment also, an adjacent coupling between resonators which are close to an input/output port is preferably set to be larger than that between resonators which are remote from an input/output port.

The resonators 267 and 269 are coupled to each other through the resonator 268, and the resonators 2614 and 2616 are coupled to each other through the resonator 2615. As a result, the complex blocks 3 and 6 are single-path-coupled through the complex block 20. Namely, the complex blocks 3 and 20 are single-path-coupled, and also the complex blocks 6 and 20 are single-path-coupled. In the embodiment, the example in which the complex blocks 3 and 20 are coupled through the single resonator 268 is shown. Alternatively, the blocks may be single-path-coupled through a further resonator(s). This is similarly applicable also to the coupling between the complex blocks 6 and 20.

An exciting portion 1 includes the resonator 261, and an exciting portion 2 includes the resonator 2622. The resonators 261 and 2622 are connected to the external. The resonator 261 is coupled to the resonator 262, and the resonator 2622 is coupled to the resonator 2621, whereby the exciting portion 1 and the complex block 3 are coupled to each other, and the exciting portion 2 and the complex block 6 are coupled to each other. In this way, the exciting portions 1 and 2 are coupled to each other. In the embodiment also, the exciting portion 1 and the complex block 3 may be single-path-coupled, and the exciting portion 2 and the complex block 6 may be single-path-coupled.

Figure 27:
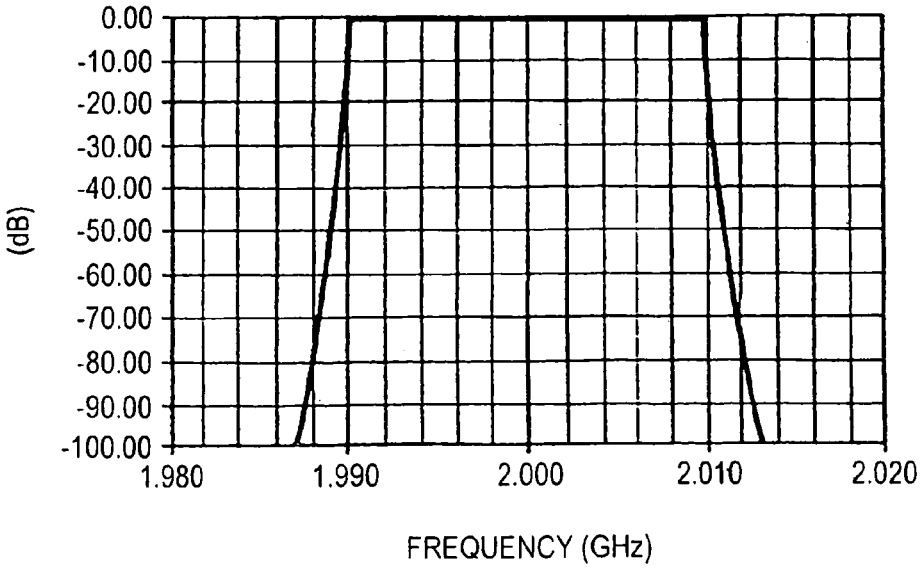
FIG. 27 is a pass amplitude characteristic diagram of the filter circuit according to the seventh embodiment of the invention.

FIG. 27 shows an example of the pass amplitude characteristic of the filter shown in FIG. 26. In the design, a normalized low-pass filter in which the transfer function has a zero at ±(1±0.3j), ±(1.5±0.4j), and ±(2±0.5j) where j is the imaginary unit was used. Namely, the figure shows the case where one complex zero is realized by the complex block 3, one complex zero is realized by the complex block 6, and one complex zero is realized by the complex block 20.

The center frequency is about 2 GHz, and the band width is about 20 MHz. In the embodiment, although an attenuation pole due to a pure imaginary zero of a transfer function does exist, a steep skirt characteristic is realized because of the large number of the filter stages. Therefore, a desired pass characteristic is realized without being disturbed by unwanted parasitic couplings.

Figure 28:
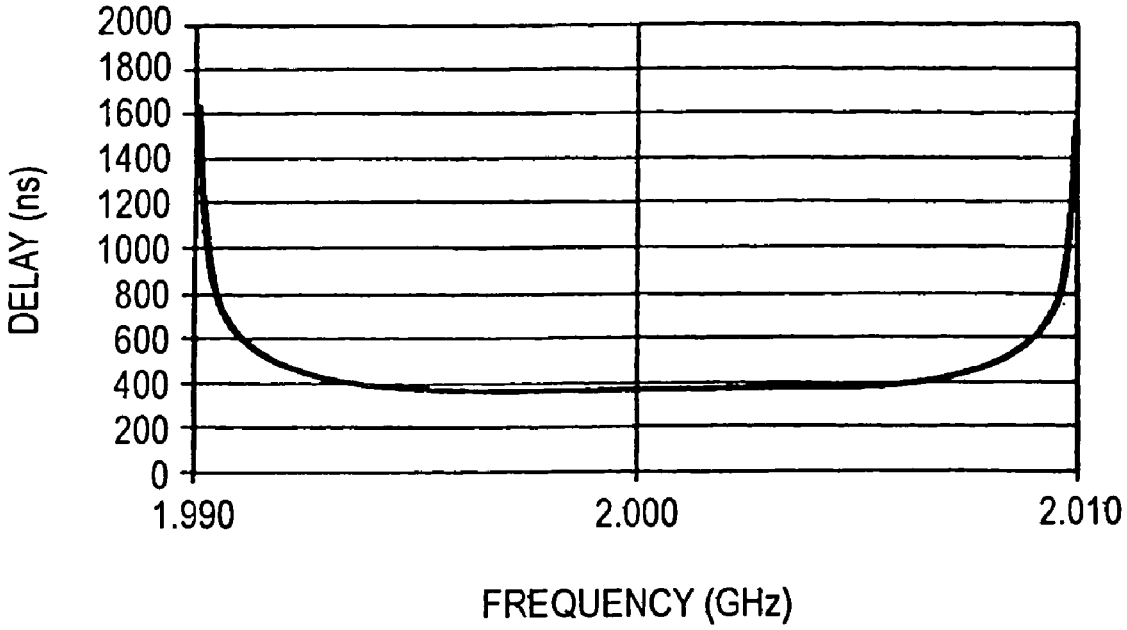
FIG. 28 is a group delay characteristic diagram of the filter circuit according to the seventh embodiment of the invention.

FIG. 28 shows the group delay characteristic of the filter. Since three complex zeros of a transfer function are disposed, a group delay characteristic which is very flat in the pass band is realized.

In the embodiment, the resonators are of the open-loop type. Alternatively, various kinds of resonators such as a meander open-loop resonator and a hairpin resonator may be used.

In the embodiment, the circuit is configured by a microstrip line. Alternatively, the circuit may be configured by a strip line. Also in the case of a waveguide filter or a dielectric filter, the filter may be configured in a similar manner. The filter characteristic can be adjusted more easily than in a conventional canonical filter. A superconductor may be employed as a conductor used in the waveguide filter or the dielectric filter.

As described above, according to the invention, both real and complex zeros of a transfer function for group delay compensation can be realized. Therefore, it is possible to realize a filter circuit having a configuration in which a pure imaginary zero of a transfer function for further steepening a skirt characteristic by means of attenuation poles can be realized, the filter characteristic is easily adjusted, and unwanted parasitic couplings are suppressed in a planar circuit such as a microstrip line or a strip line.

What is claimed is:

1. A filter circuit comprising:

a complex block which realizes a complex zero of a transfer function;

a real/pure imaginary block which realizes a real zero of a transfer function and a pure imaginary zero of the transfer function; and a single path circuit which couples the complex block with the real/pure imaginary block through a single-path, wherein the complex block comprises: a first end resonator; a first resonator that is coupled to the first end resonator; a second resonator that is coupled to the first resonator; a third resonator that is coupled to the second resonator; a fourth resonator that is coupled to the third resonator; and a second end resonator that is coupled to the fourth resonator; and a coupling between the first end resonator and the second end resonator, a coupling between the first resonator and the fourth resonator, and a coupling between the second resonator and the third resonator are in phase.

2. The filter circuit according to claim 1, wherein the real/pure imaginary block comprises: a third end resonator; a fifth resonator that is coupled to the third end resonator; a sixth resonator that is coupled to the fifth resonator; a seventh resonator that is coupled to the sixth resonator; an eighth resonator that is coupled to the seventh resonator; and a fourth end resonator that is coupled to the eighth resonator; and among a coupling between the third end resonator and the fourth end resonator, a coupling between the fifth resonator and the eighth resonator, and a coupling between the sixth resonator and the seventh resonator, one set of adjacent ones is in phase.

3. The filter circuit according to claim 1, wherein the real/pure imaginary block comprises: a third end resonator; a fifth resonator that is coupled to the third end resonator; a sixth resonator that is coupled to the fifth resonator; a seventh resonator that is coupled to the sixth resonator; an eighth resonator that is coupled to the seventh resonator; and a fourth end resonator that is coupled to the eighth resonator, and;

among a coupling between the third end resonator and the fourth end resonator, a coupling between the fifth resonator and the eighth resonator, and a coupling between the sixth resonator and the seventh resonator, all sets of adjacent ones are in anti-phase.

4. The filter circuit according to claim 1, further comprising: a second complex block which realizes a complex zero of a transfer function.

5. The filter circuit according to claim 1, wherein the coupling between the first end resonator and the first resonator is larger than the coupling between the fourth resonator and the second end resonator.

6. The filter circuit according to claim 1, wherein the complex zero deviates from a real axis and an imaginary axis.

7. A filter circuit comprising:

a complex block which realizes a complex zero of a transfer function;

a real block which realizes a real zero of a transfer function; and a single path circuit which couples the complex block with the real block through a single-path, wherein the complex block comprises: a first end resonator; a first resonator that is coupled to the first end resonator; a second resonator that is coupled to the first resonator; a third resonator that is coupled to the second resonator; a fourth resonator that is coupled to the third resonator; and a second end resonator that is coupled to the fourth resonator; and a coupling between the first end resonator and the second end resonator, a coupling between the first resonator and the fourth resonator, and a coupling between the second resonator and the third resonator are in phase.

8. The filter circuit according to claim 7, wherein the real block comprises: a third end resonator; a fifth resonator that is coupled to the third end resonator; a sixth resonator that is coupled to the fifth resonator; and a fourth end resonator that is coupled to the sixth resonator; and a coupling between the third end resonator and the fourth end resonator, and a coupling between the fifth resonator and the sixth resonator are in phase.

9. The filter circuit according to claim 7, further comprising: a pure imaginary block which realizes a pure imaginary zero of a transfer function.

10. The filter circuit according to claim 9, further comprising: a second single path circuit which couples the complex block with the pure imaginary block through a single-path.

11. The filter circuit according to claim 7, wherein the complex zero deviates from a real axis and an imaginary axis.

12. A filter circuit comprising:

a complex block which realizes a complex zero of a transfer function;

a pure imaginary block which realizes a pure imaginary zero of a transfer function; and a single path circuit which couples the complex block with the pure imaginary block through a single-path, wherein the complex block comprises: a first end resonator; a first resonator that is coupled to the first end resonator; a second resonator that is coupled to the first resonator; a third resonator that is coupled to the second resonator; a fourth resonator that is coupled to the third resonator; and a second end resonator that is coupled to the fourth resonator; and a coupling between the first end resonator and the second end resonator, a coupling between the first resonator and the fourth resonator, and a coupling between the second resonator and the third resonator are in phase.

13. The filter circuit according to claim 12, wherein the pure imaginary block comprises: a third end resonator; a fifth resonator that is coupled to the third end resonator; a sixth resonator that is coupled to the fifth resonator; and a fourth end resonator that is coupled to the sixth resonator; and a coupling between the third end resonator and the fourth end resonator, and a coupling between the fifth resonator and the sixth resonator are in anti-phase.

14. The filter circuit according to claim 12, further comprising: a real block which realizes a real zero of a transfer function.

15. The filter circuit according to claim 14, further comprising: a second single path circuit which couples the real block with the pure imaginary block through a single-path.

16. The filter circuit according to claim 12, wherein the complex zero deviates from a real axis and an imaginary axis.

17. A filter circuit comprising:

a first complex block which realizes a complex zero of a transfer function;

a second complex block which realizes a complex zero of a transfer function; and a single path circuit which couples the first complex block with the second complex block through a single-path, wherein the first complex block comprises: a first end resonator; a first resonator that is coupled to the first end resonator; a second resonator that is coupled to the first resonator; a third resonator that is coupled to the second resonator; a fourth resonator that is coupled to the third resonator; and a second end resonator that is coupled to the fourth resonator, a coupling between the first end resonator and the second end resonator, a coupling between the first resonator and the fourth resonator, and a coupling between the second resonator and the third resonator are in phase, the second complex block comprises: a fifth end resonator; a seventh resonator that is coupled to the fifth end resonator; an eighth resonator that is coupled to the seventh resonator; a ninth resonator that is coupled to the eighth resonator; a tenth resonator that is coupled to the ninth resonator; and a sixth end resonator that is coupled to the tenth resonator, and a coupling between the fifth end resonator and the sixth end resonator, a coupling between the seventh resonator and the tenth resonator, and a coupling between the eight resonator and the ninth resonator are in phase.

18. The filter circuit according to claim 17, wherein the complex zero deviates from a real axis and an imaginary axis.

19. A filter circuit having a pass amplitude characteristic with a predetermined pass band, comprising:

a first circuit which realizes attenuation poles on both sides of the predetermined pass band in the pass amplitude characteristic; and a second circuit which realizes a flat group delay characteristic in the pass band;

wherein the first circuit and the second circuit are coupled with a single path;

the second circuit comprises: a first end resonator; a first resonator that is coupled to the first end resonator; a second resonator that is coupled to the first resonator; a third resonator that is coupled to the second resonator; a fourth resonator that is coupled to the third resonator; and a second end resonator that is coupled to the fourth resonator; and a coupling between the first end resonator and the second end resonator, a coupling between the first resonator and the fourth resonator, and a coupling between the second resonator and the third resonator are in phase.

20. The filter circuit according to claim 19, wherein the first circuit comprises: a third end resonator; a fifth resonator that is coupled to the third end resonator; a sixth resonator that is coupled to the fifth resonator; a seventh resonator that is coupled to the sixth resonator; an eighth resonator that is coupled to the seventh resonator; and a fourth end resonator that is coupled to the eighth resonator; and among a coupling between the third end resonator and the fourth end resonator, a coupling between the fifth resonator and the eighth resonator, and a coupling between the sixth resonator and the seventh resonator, one set of adjacent ones is in phase.

21. The filter circuit according to claim 19, wherein the first circuit comprises: a third end resonator; a fifth resonator that is coupled to the third end resonator; a sixth resonator that is coupled to the fifth resonator; a seventh resonator that is coupled to the sixth resonator; an eighth resonator that is coupled to the seventh resonator; and a fourth end resonator that is coupled to the eighth resonator, and;

among a coupling between the third end resonator and the fourth end resonator, a coupling between the fifth resonator and the eighth resonator, and a coupling between the sixth resonator and the seventh resonator, one set of adjacent ones is in anti-phase.

22. The filter circuit according to claim 19, wherein the first circuit comprises: a third end resonator; a fifth resonator that is coupled to the third end resonator; a sixth resonator that is coupled to the fifth resonator; and a fourth end resonator that is coupled to the sixth resonator; and a coupling between the third end resonator and the fourth end resonator, and a coupling between the fifth resonator and the sixth resonator are in anti-phase.

23. The filter circuit according to claim 19, wherein the first circuit and the second circuit include a plurality of resonators; and at least one of the plurality of resonators is formed by a superconductor.

24. The filter circuit according to claim 19, wherein the second circuit realizes a complex zero that deviates from a real axis and an imaginary axis.

* * * * *